US005967261A

United States Patent [19]

Sandham et al.

[11] Patent Number: 5,967,261

[45] Date of Patent: Oct. 19, 1999

[54] STAIR-LADDER PLATFORM

[76] Inventors: John M. Sandham, 3 Suttons Gardens, Hornchurch, Essex, United Kingdom, RM12 4LD; Stanley Trevor Lewis, 42 Berwick Road, Rainham, Essex, United Kingdom, RM13 9Ql

[21] Appl. No.: 08/821,250

[22] Filed: Mar. 20, 1997

[51] Int. Cl.[6] ..... E06C 7/44

[52] U.S. Cl. ..... 182/200; 182/223

[58] Field of Search ..... 182/200, 45, 107, 182/223; 108/115, 35, 38; 248/439, 188.4

[56] References Cited

U.S. PATENT DOCUMENTS

| | | | |
|---|---|---|---|
| 87,709 | 3/1869 | Rollo . | |
| D. 260,683 | 9/1981 | Kokoska | D25/65 |
| 393,169 | 11/1888 | McGowan | 182/33.2 |
| 1,057,722 | 4/1913 | Goetz | 182/200 |
| 2,012,660 | 8/1935 | Dunning . | |
| 2,549,638 | 4/1951 | Rogghe . | |
| 4,133,272 | 1/1979 | Naglowsky | 248/439 |
| 4,457,397 | 7/1984 | Scala | 182/200 |
| 4,708,239 | 11/1987 | Bourbon . | |
| 5,339,921 | 8/1994 | Faupel | 182/200 |

FOREIGN PATENT DOCUMENTS

| | | | |
|---|---|---|---|
| 276322 | 2/1990 | Germany | 182/200 |
| 2142965 | 1/1985 | United Kingdom | 182/107 |

OTHER PUBLICATIONS

Popular Science, Jul. 1945.

*Primary Examiner*—Alvin Chin-Shue
*Attorney, Agent, or Firm*—Browdy and Neimark

[57] ABSTRACT

A portable stair-ladder platform comprising a adder support platform (1) and a support member (3,21,41,59,75,85) pivotally attached to the platform by a pivotal coupling (9,84, 86), the parts being arranged such that, when assembled and in use with the ladder support platform substantially horizontal and the support member substantially vertical, an upwardly-facing surface area of the support member abuts a downwardly-facing surface area of the ladder support platform, the pivotal coupling and the surface areas being arranged to tend to maintain substantially a right angle between the abutting parts even when weight is applied to the ladder support platform, and the pivotal coupling being such as to prevent pivoting of the support member substantially beyond the vertical in that angular direction which is towards the underside of the ladder support platform but while allowing pivoting of the support member in the other direction so as to allow the device to be collapsed for transportation or storage.

6 Claims, 32 Drawing Sheets

STAIR-LADDER PLATFORM

This invention relates to a portable stair platform for use with a ladder.

Stairs are well-known to be awkward places in which to work from, be it decorating or carrying out general maintenance to adjoining walls and ceilings.

When undertaking such tasks, the standard method used is a scaffold board bridged across two ladders pitched at different heights along the run of the staircase. This is not only very unstable, but does not enable the user to reach high ceilings and walls.

Purpose built towers are available on the market which are more stable than the makeshift method, but are not completely movement free, are very large and relatively expensive. When in use, stairwells are blocked rendering them and whole floor areas out of use. Moreover, when not in use these towers are very bulky to store and not designed with ease of transport in mind.

Stair ladders can also be purchased, but are very limited in their application. One must not work above a certain point, thus limiting the heights which can be reached.

According to a first aspect of the present invention, there is provided a stair-ladder platform device which is collapsible for transportation and storage and comprises a ladder support platform and a support member pivotally attached to the ladder support platform by a pivotal coupling, the ladder support platform having a recessed portion to receive the support member in the collapsed state of the device, the parts being arranged such that, when assembled and in use with the ladder support platform substantially horizontal and the support member substantially vertical, an upwardly-facing surface area of the support member abuts a downwardly-facing surface area of the ladder support platform, the pivotal coupling and the surface areas being arranged to tend to maintain substantially a right angle between the abutting parts even when weight is applied to the ladder support platform, and wherein the pivotal coupling is adapted to allow the support member to be displaced to a position in which it is received in the recessed portion of the ladder support platform for storage and/or transport.

Advantageously, when the device is assembled and in use, the pivotal coupling is such as to prevent pivoting of the support member substantially beyond the vertical in that angular direction which is towards the underside of the ladder support platform but whilst allowing pivoting of the support member in the other direction so as to allow the device to be collapsed for transportation or storage.

According to a second aspect of the present invention, which may be additional to or alternative to the first aspect, there is provided a stair-ladder platform device which is collapsible for transportation and storage and comprises a ladder support platform and a support member pivotally attached to the platform by a pivotal coupling, the parts being arranged such that, when assembled and in use with the ladder support platform substantially horizontal and the support member substantially vertical, an upwardly-facing surface area of the support member abuts a downwardly-facing surface area of the ladder support platform, the pivotal coupling and the surface areas being arranged to tend to maintain substantially a right angle between the abutting parts even when weight is applied to the ladder support platform, and the pivotal coupling being such as to prevent pivoting of the support member substantially beyond the vertical in that angular direction which is towards the underside of the ladder support platform but allowing pivoting of the support member in the other direction so as to allow the device to be collapsed for transportation or storage.

Advantageously, there is provided a surface area of the support member which surface area, when the device is assembled and in use with the ladder support platform substantially horizontal and the support member substantially vertical, abuts an opposing surface area of the ladder support platform, the pivotal coupling being located above the abutting surface areas so as to prevent pivoting of the support member about a fulcrum defined by the abutting surface areas substantially beyond the vertical in that angular direction which is towards the underside of the ladder support platform but allowing pivoting of the support member in the other direction so as to allow the device to be collapsed for transportation or storage.

The opposing surface areas may be additional to or replace the upwardly- and downwardly-facing surface areas described above. The planes of the opposing surface areas are oriented so as to have at least a vertical component, and in some embodiments are substantially vertical. This arrangement provides additional stability for the stair-ladder platform when assembled and in use.

In a preferred embodiment, the pivotal coupling is such as to allow the support member to slide relative to the ladder support platform when the device is being assembled or collapsed. In one suitable form of pivotal coupling, the coupling comprises engagement means carried by one of the support member and the ladder support platform, which engagement means is slidably engageable in a pair of substantially parallel elongate guides provided along the length of the other of the support member and the ladder support platform. The elongate guides may be formed on the inner faces of a pair of ladder stops, one being provided along either edge of the ladder support platform. This arrangement provides the advantage that a rigid platform may be set up simply by sliding the support member relative to the ladder support platform from an initial, compact configuration, in which the support member and the ladder support platform are substantially parallel and adjacent, to an intermediate configuration in which the support member is still parallel to, but overhangs, the ladder support platform, to a final, working configuration, in which the support member is pivoted downwardly so that a surface area of the support member abuts a surface area of the ladder support platform in such a way that substantially all weight applied to the ladder support platform is borne by the abutting surface areas and not by the pivotal attachments.

Alternatively, the engagement means may be located at one end region of the ladder support platform and the elongate guides may be formed along the edges of the support member.

In a further alternative embodiment, the pivotal coupling may be releasable, thereby enabling the support member to be released from its initial configuration relative to the ladder support platform and re-attached in the final, working configuration.

In a particularly preferred embodiment, the support member is provided at one end with a transverse bar, and both inner faces of the ladder stops on the ladder support platform are provided with an elongate guide adapted to receive one end each of the transverse bar. The support member and the ladder support platform can be separated from each other by applying a relative twisting motion when the stair-ladder platform is in its intermediate configuration so as to disengage the ends of the transverse bar from the elongate guides. Because of the way in which the respective surface areas of the support member and the ladder support platform abut each other when the stair-ladder platform is in its final, working configuration, it is not possible to apply this twisting motion when the stair-ladder is in use, thereby ensuring good stability. This embodiment provides the advantage that the support member and the ladder support platform may be manufactured separately, for example by way of injection moulding, thereby reducing manufacturing costs. Advantageously, the inner faces of the ladder stops are provided with a lip or bulge in the region above the elongate guides. This lip or bulge serves firstly to retain the support member in the recess of the ladder support platform when the stair-ladder platform is in the collapsed state of the device, and secondly to prevent the support member from being inserted incorrectly, since the lip or bulge will only allow the support member to pivot fully between the collapsed state and the fully-assembled state when the support member is positioned so that its aforementioned surface area will correctly abut the aforementioned surface area of the ladder support platform.

Instead of a sliding arrangement, the support member may be attached to the ladder support platform by a simple pivot arrangement, the support member being swung about an angle in the region of 270° from the initial position to the final position.

Although embodiments of the present invention are inherently stable in use because of the way that the abutting surface areas of the support member and the ladder support platform are designed, in combination with the pivotal coupling, to form a rigid interface under applied weight, it is possible to provide an additional locking means for added safety. This locking means may comprise a clip or turnkey or the like mounted at one end of the ladder support platform and adapted to be releasably secured to the support member when the stair-ladder platform is in its assembled state by engaging with a hole provided in the support member.

The stair-ladder platform is advantageously adapted to extend, in use, over no more than two stairs. In other words, the respective lengths of the support member and the ladder support platform are such that when the stair-ladder platform is erected, the base of the support member rests on a first stair going, and the ladder support platform rests on the going of the stair no more than two above the first. This embodiment of the present invention is particularly stable in use.

Embodiments of the invention featuring the recessed portion in the ladder support platform of the first aspect may advantageously comprise a base which, when the device is assembled and in use, is located at the lower end of the support member, and is shaped so that, when the device is in a collapsed state for transportation or storage, the base closes one end of a channel defined in the ladder support platform by the recessed portion.

The base can provide additional stability for the stair-ladder platform device when assembled, and enables the device to adopt a neat and compact configuration when collapsed, since the base may be shaped and sized so as to form a closure panel which is substantially flush with the cross-section of the ladder support platform and the support member when these are in the collapsed state. The base may be non-pivotally or pivotally attached to the support member.

In some embodiments of the present invention, there is provided a base pivotally attached to the support member, which base, when the device is assembled and in use with the ladder support platform and the base substantially horizontal and the support member substantially vertical, an upwardly-facing surface area of the base abuts a downwardly-facing surface area of the support member, the pivotal coupling and the surface areas being arranged to tend to maintain substantially a right angle between the abutting parts even when weight is applied to the ladder support platform.

The base helps to provide additional stability for the stair-ladder platform as a whole.

According to a third aspect of the present invention, which may be additional to or alternative to the first and second aspects, there is provided a stair-ladder platform which is collapsible for transportation and storage and comprises three parts: i) a ladder support platform, ii) a support member pivotally attached to the platform and iii) a base pivotally attached to the support member, the parts being arranged such that, when assembled for use, a first surface area of the support member abuts a surface area of the ladder support platform and a second surface area of the support member abuts a surface area of the base, the pivotal attachments and the surface areas being arranged to tend to maintain substantially a right angle between each pair of abutting parts when weight is applied to the ladder support platform.

In one embodiment, the support platform is attached to the support member in such a way that the support member traverses through an angle in the region of 270° in going from its collapsed to its assembled condition.

According to a fourth aspect of the present invention, which may be additional to or alternative to the first, second and third aspects, there is provided a stair-ladder platform device which is collapsible for transportation and storage and comprises a ladder support platform and a support member pivotally attached to the platform, wherein the support member is provided with a height adjustment in the form of a telescopic mechanism.

A telescopic mechanism is to be understood in this context as one in which the support member comprises at least two parts which may be reciprocated without relative rotational movement of the parts (although it is envisaged that a rotational mechanism, such as a worm screw, may be used to generate the reciprocal motion). Such a telescopic height adjustment allows the stair-ladder platform to be set quickly and accurately for different sizes of stair riser.

According to a fifth aspect of the invention, which may be additional to or alternative to the first, second, third and fourth aspects, there is provided a stair-ladder platform which is collapsible for transportation and storage and comprises two parts: i) a ladder support platform and ii) a support member pivotally attached to the platform, there being a height adjustment in the form of a jacking mechanism, or other screw-threaded mechanism, activated by one or more handles.

Embodiments of the stair-ladder platform can be used in conjunction with a wide range of general purpose ladders incorporating height and width-adjusting methods for use with variable stair sizes, for example domestic, institutional or industrial stair types. These embodiments can be quickly retracted for compact storage and transportation and can be adapted to be constructed from any suitable material, including wood, strengthened aluminium, pressed steel or even suitable plastics.

Preferably, the parts are arranged such that, when assembled for use, the support member has a surface area which abuts a surface area of the ladder support platform, the pivotal attachment and the surface areas being arranged to tend to maintain substantially a right angle between the abutting parts when weight is applied to the ladder support platform.

In addition, there may be provided a ladder support platform adjustment to accommodate different widths of going on stairs, for example in the form of a manually-guided mechanism or a jacking mechanism, or other screw-threaded mechanism, activated by one or more handles. Alternatively or in addition, a telescopic mechanism may be used.

Further aspects and alternatives will be apparent from the following descriptions:

Figure 1:
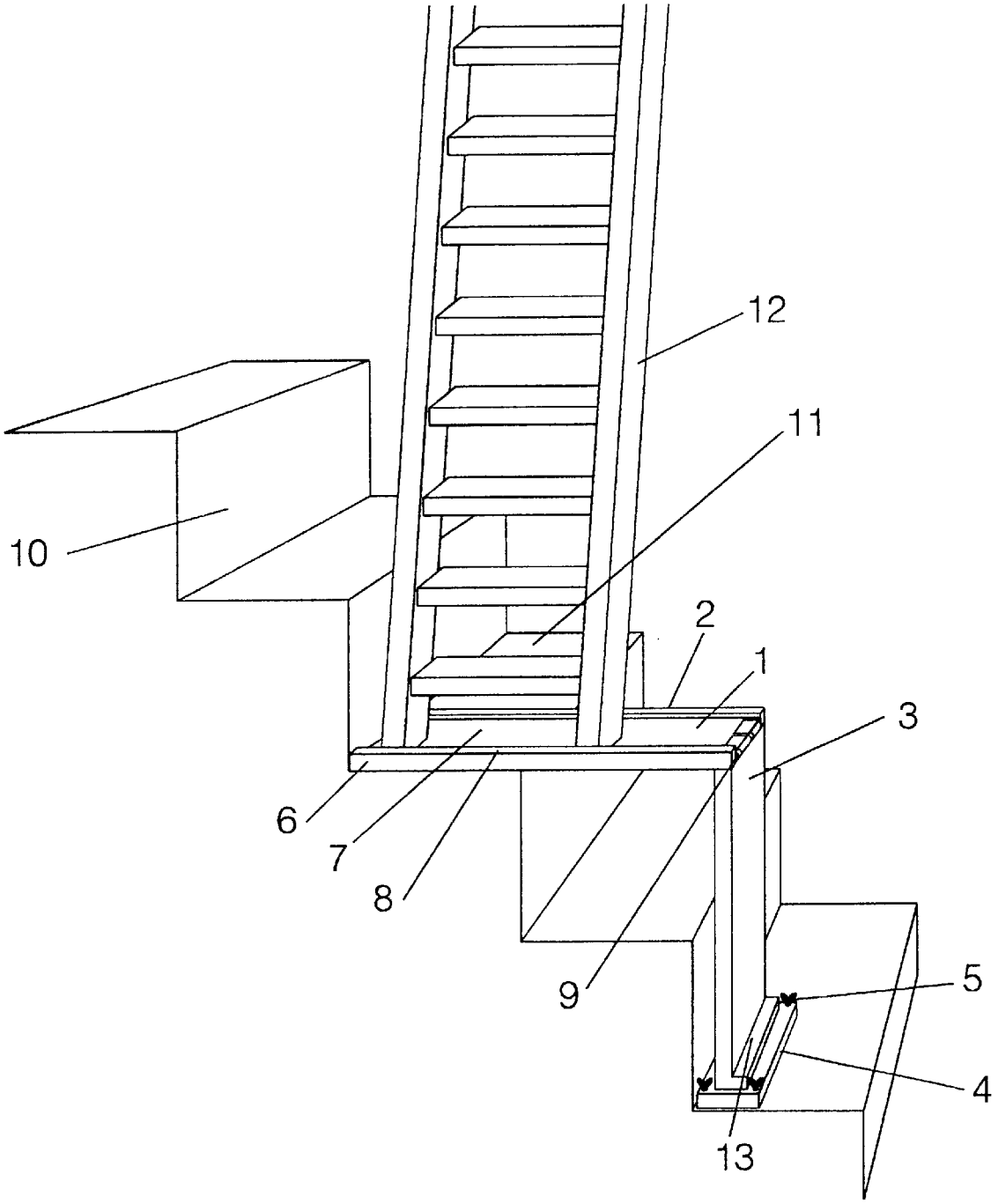
FIG. 1 shows in perspective one example of the stair-ladder platform with a ladder in use.
Figure 2:
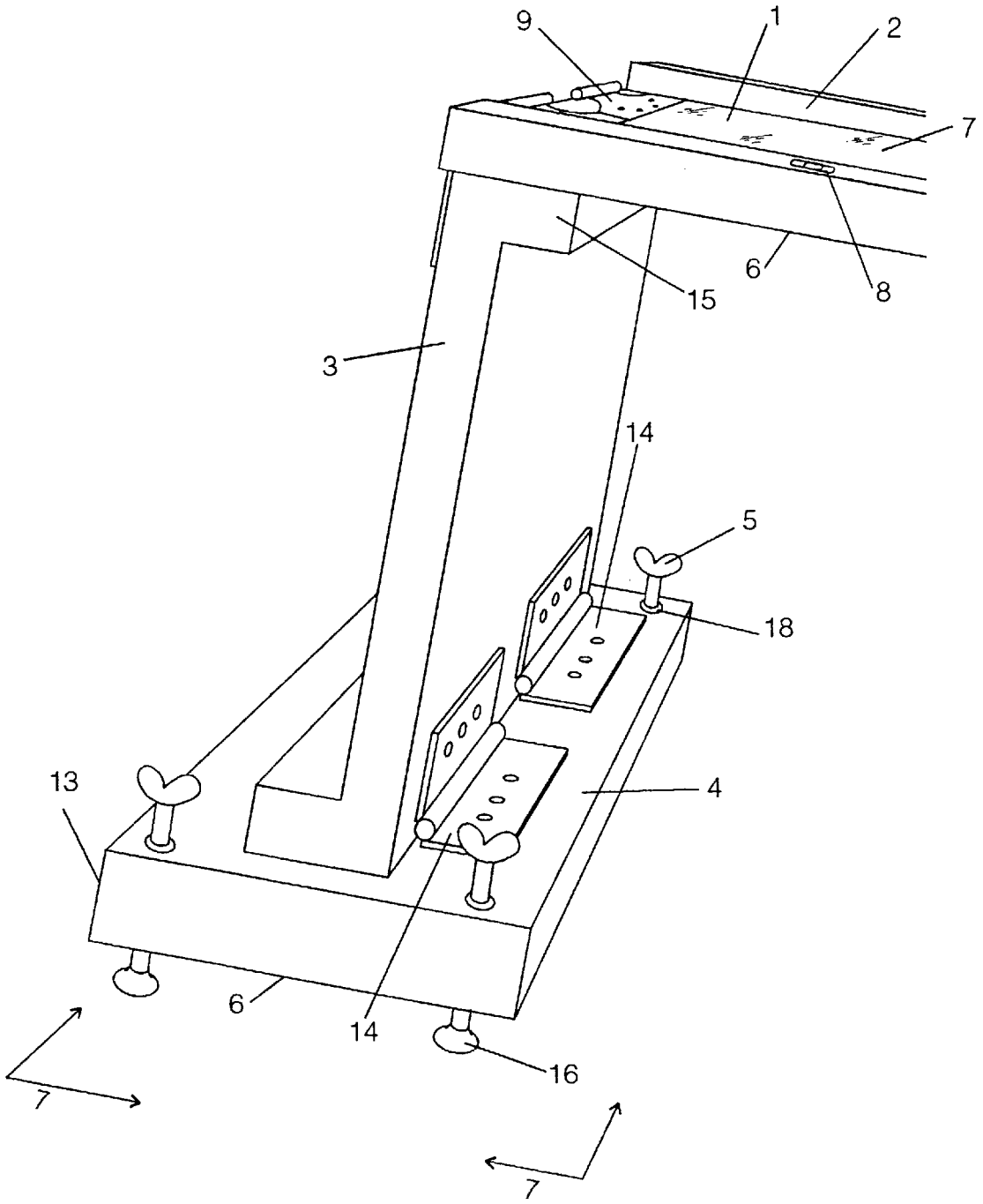
FIG. 2 shows an enlarged perspective view of the stair-ladder platform of FIG. 1.
Figure 5:
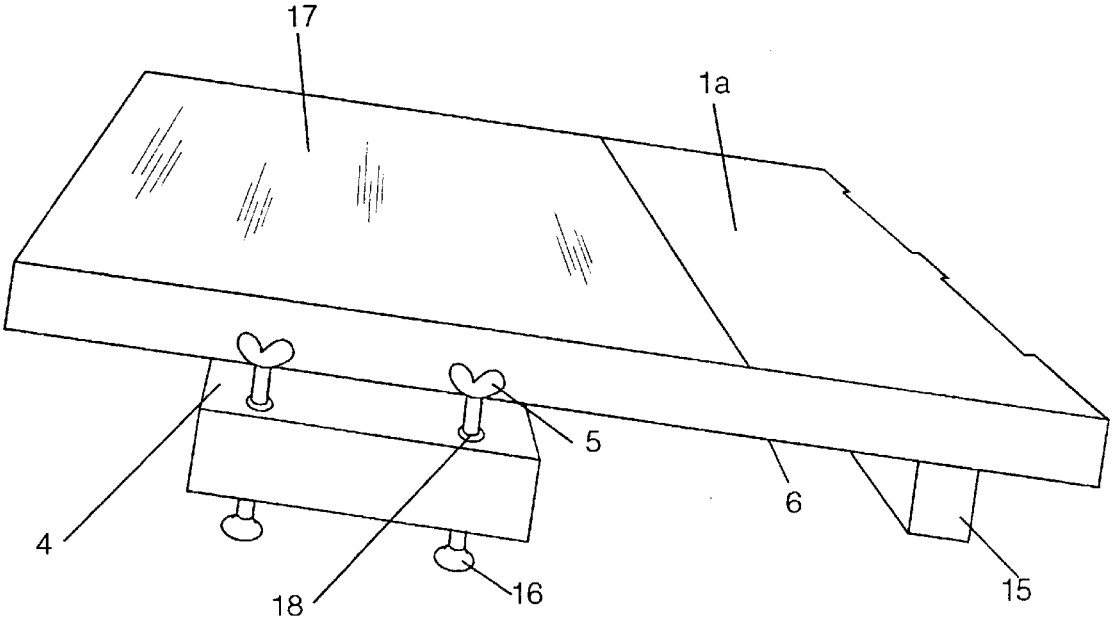
FIG. 5 illustrates the underside of the example shown in FIGS. 1–4.
Figure 6:
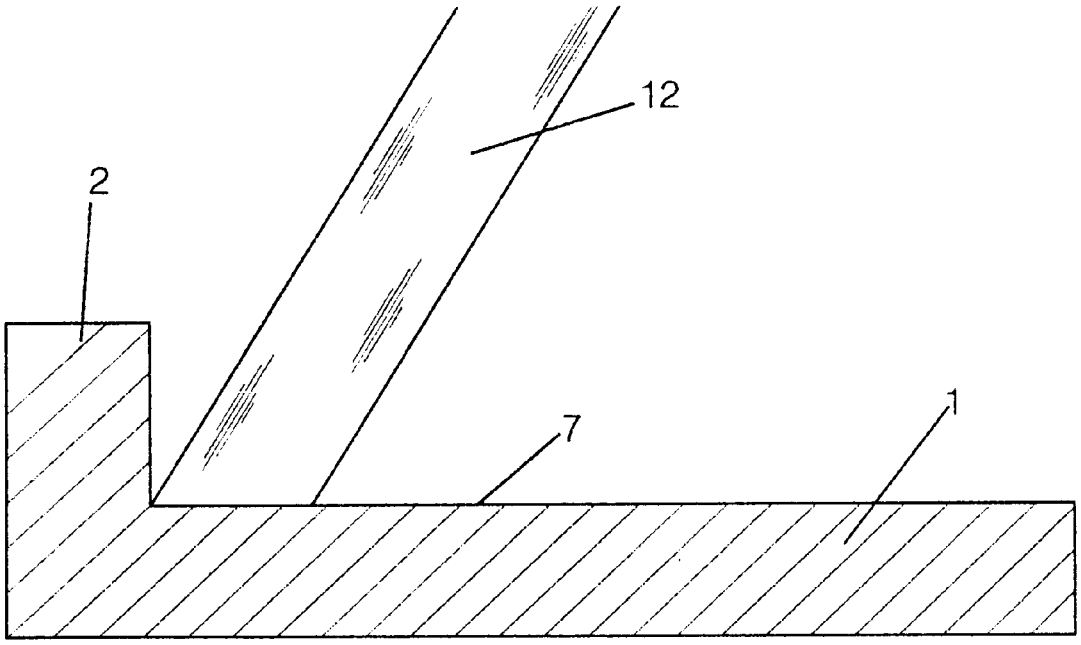
FIG. 6 shows an enlarged fragmentary view of the platform and ladder stops.
Figure 7:
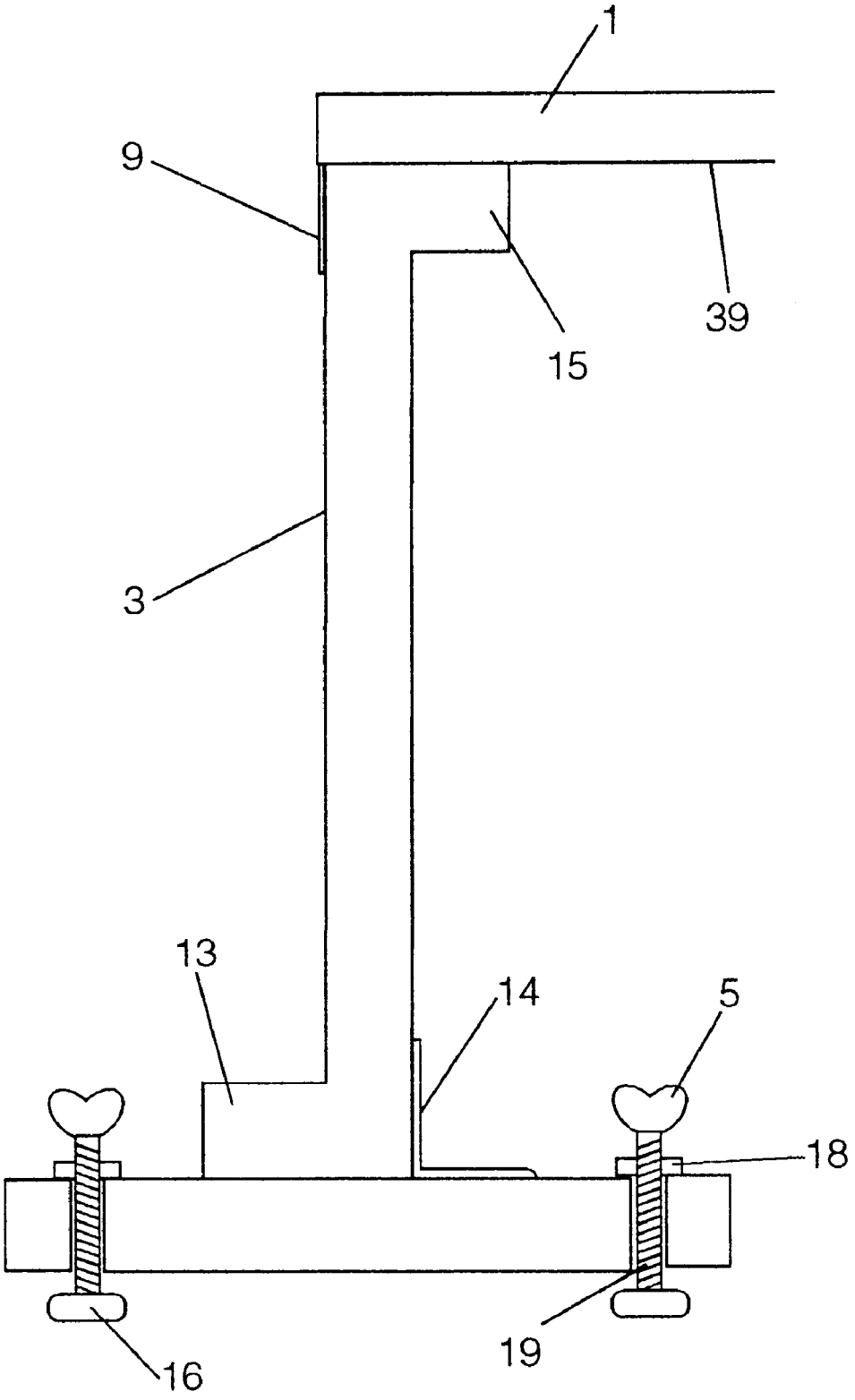
FIG. 7 shows a cross-sectional view taken substantially in the plane of the line 7—7 in FIG. 2.

Referring to the drawings, FIG. 1 illustrates one embodiment of the stair-ladder platform, comprising a platform 1 with integral ladder stops 2 and a vertical support member 3 pivotally attached by hinges 9, best shown in FIG. 2. A support-to-platform stop 15 fixed to the vertical support 3 abuts the platform 1 at right angles to the said member as also shown in FIG. 7. A base 4 is pivotally attached by hinges 14 to the support 3 on the sides opposite to the platform hinges 9. The support-to-base stop 13 abuts the base 4 at right angles, the opposing forces of hinges 9 and 14 along with oppositely fixed support stops 15 and 13 effecting a rigid structure best shown in FIG. 7. Wing-nutted height adjusters 5 are connected by threaded sleeves 19 and wingnut stops 18 to adjustable feet 16 (as shown in FIG. 7) to enable the platform 1 to be aligned horizontally on a stair going 11. A spirit level 8 may be provided to assist alignment. The edge of platform 1 opposite to the platform hinges 9 is butted against a stair riser 10 (see FIG. 1). Buffers 6 located on the outer edge of the platform 1 and the base 4 are to protect the surface abutted by the stair-ladder platform. A non-slip rubber stair grip 17, best shown in FIG. 5, grips the stair going 11 when the ladder 12 is positioned on the non-slip ladder grip 7 (as shown in FIG. 6) and pitched against the wall of the staircase and weight applied.

Figure 3:
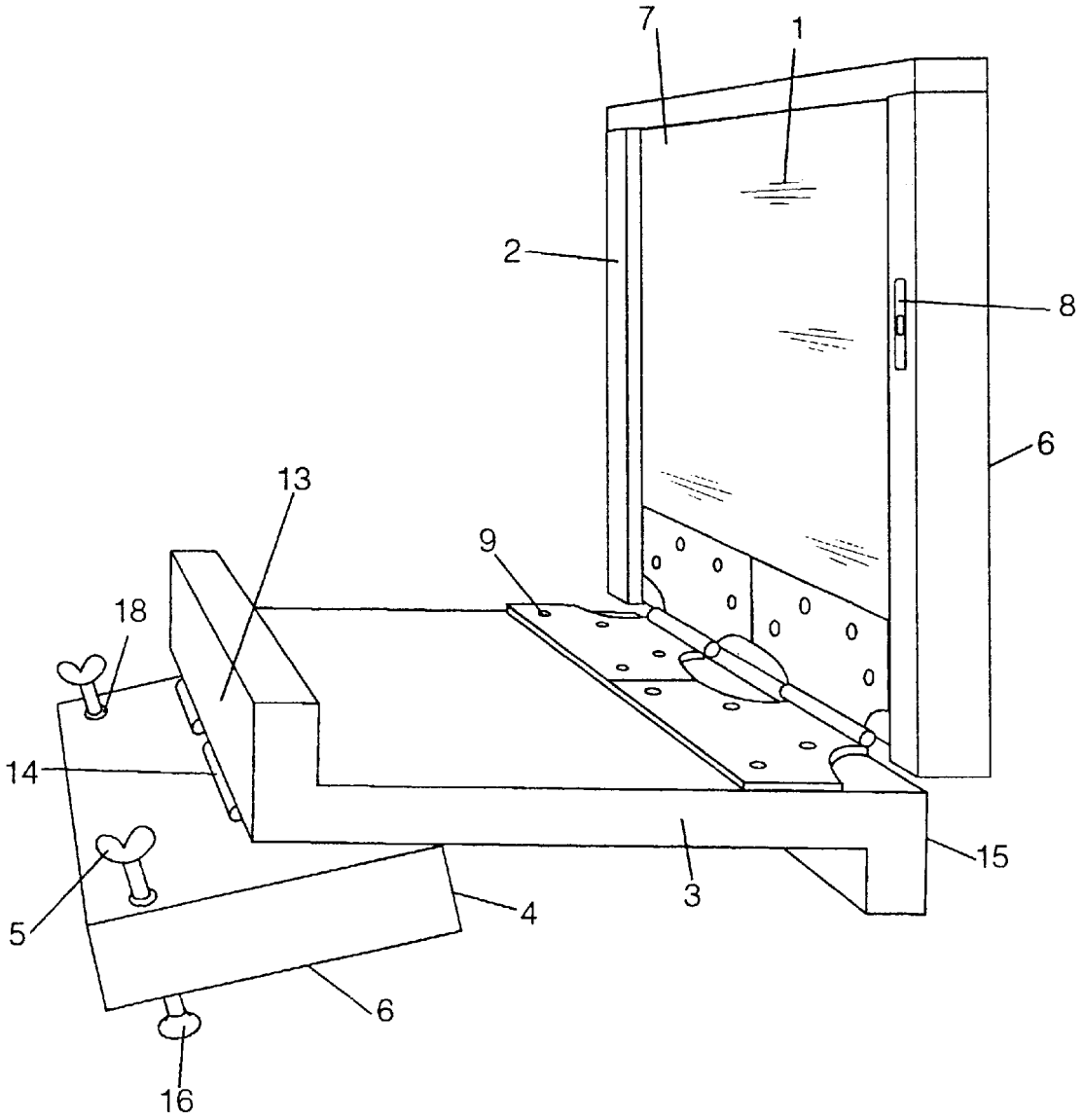
FIG. 3 shows a perspective view of the example shown in FIG. 1 and FIG. 2 folding into its closed, portable/storage position.
Figure 4:
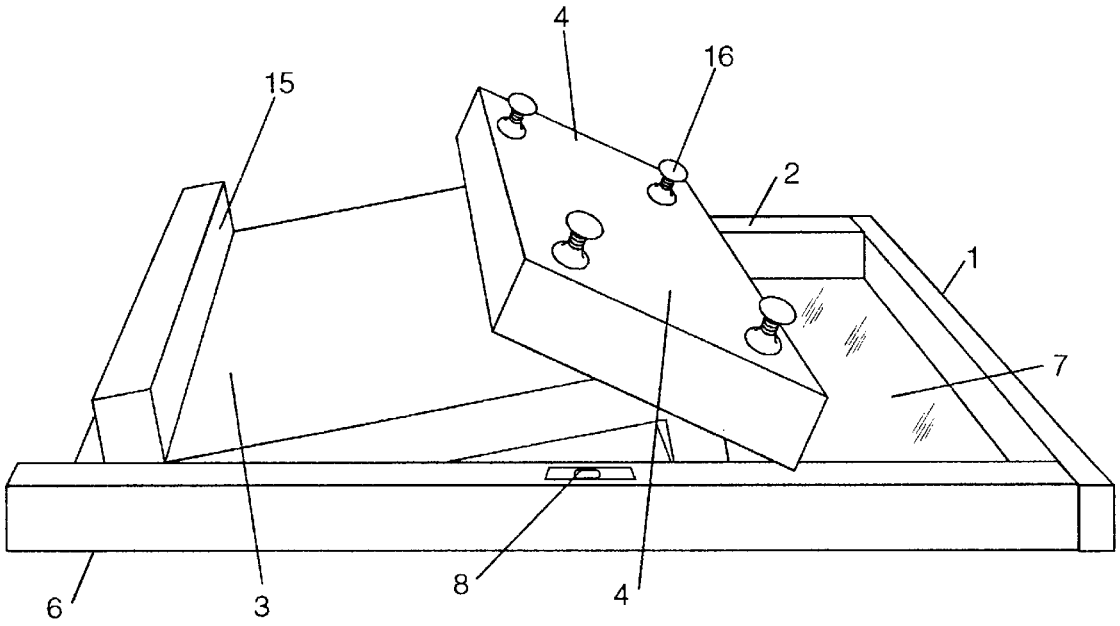
FIG. 4 shows a perspective view of the example shown in FIGS. 1–3 in its closed, portable/storage position.

After use, the ladder 12 is removed and the stair-ladder platform is pivotally collapsed about its pivoted axis 9 and 14 as shown in FIG. 3 to a compact stowed position, best shown in FIG. 4.

The stair-ladder platform can be placed anywhere within a staircase by following the procedures above.

Figure 8:
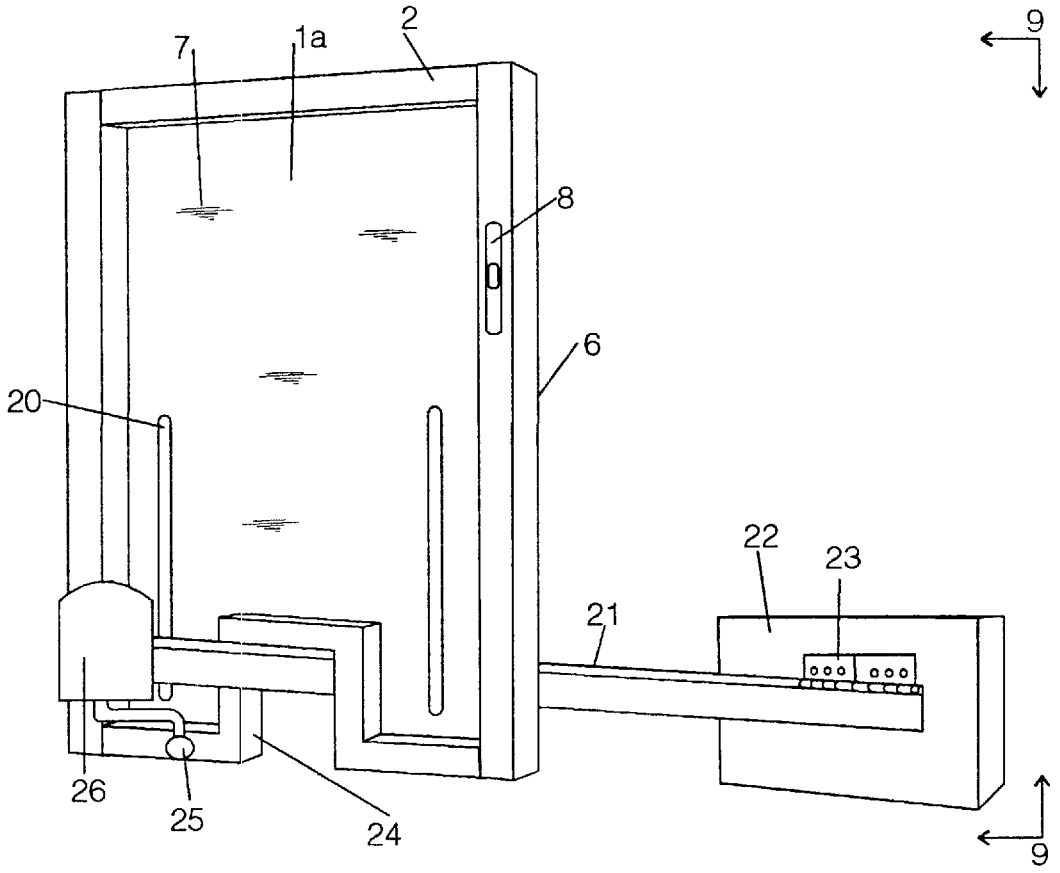
FIG. 8 shows in perspective an alternative example of a stair-ladder platform.

A second embodiment of the stair-ladder platform can best be seen in FIG. 8. This alternative embodiment comprises a platform la with integral ladder stops 2 and a vertical support 21 pivotally fixed by a bar-hinged support strut 31 to a recessed metal slide plate 32, best shown in FIG. 9. The support 21 pivots on a bar hinge 30 parallel to the platform 1*a*, best shown in FIGS. 9 and 12, to the vertical, with hinged base 22 pivotally attached by hinges 23 abutting the support/base stop 36 at right angles with the base 22 and support 21, as best shown FIGS. 8 and 9. The support 21 can be moved towards or away from the stair riser 10 within the width-adjusting support guide 24, best shown in FIG. 8. The recessed metal slide plate 32 slides within metal plate guides 38, best shown in FIG. 10. Wing-nutted bolts 34 fixed through holes in the metal slide plate 32 are guided within recessed bolt guides 20 (see FIG. 9) to a desired position and locked.

A non-slip rubber grip 17 sits firmly on the stair going 11 with the leading buffered edge 6 of the platform 1*a* opposite to the support member abutting the stair riser 10 as shown in FIG. 1.

A height adjusting handle 25 activates a jack gearing 27 within a housing 26 which in turn rotates a height-adjusting worm 28 clockwise or anti-clockwise depending on the desired platform height.

Figure 9:
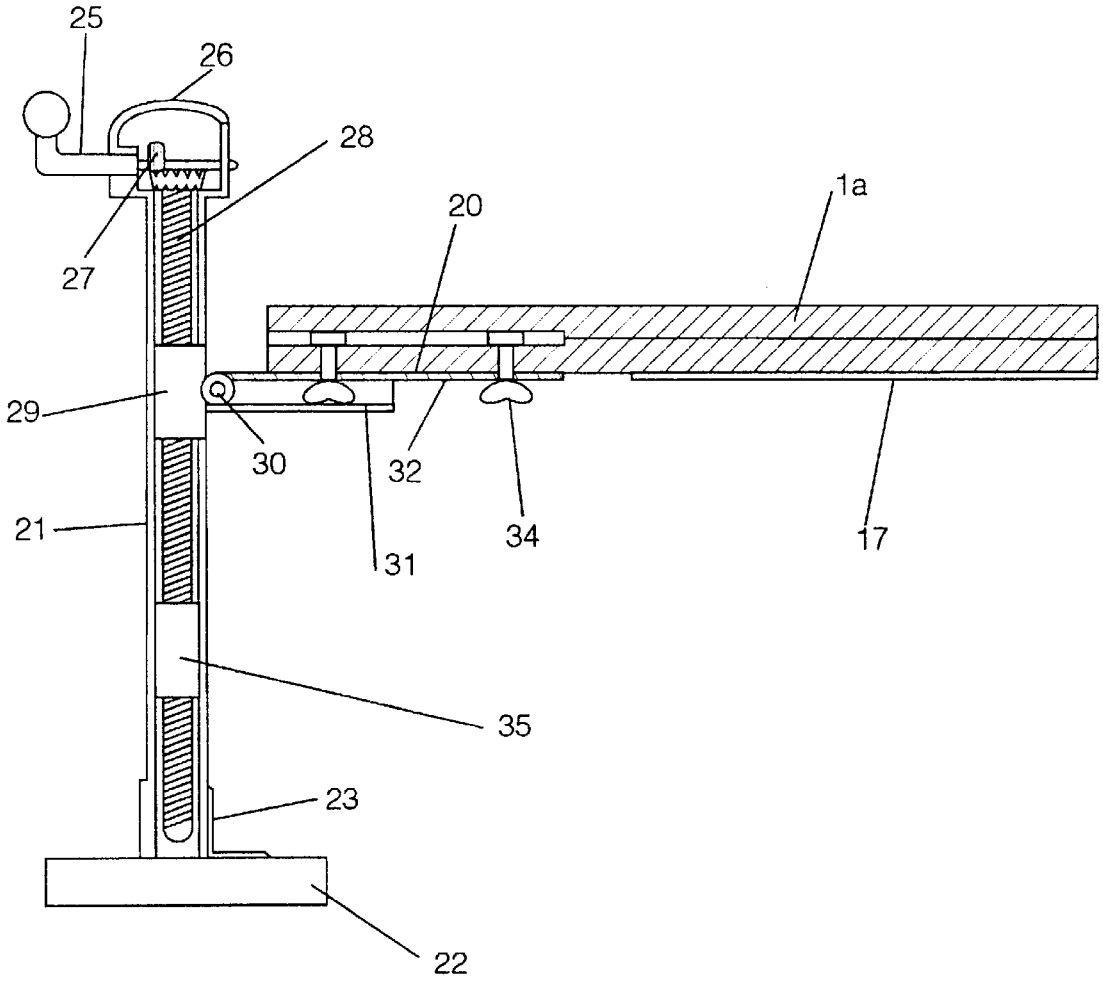
FIG. 9 shows a cross-sectional view taken substantially in the plane of the line 9—9 in FIG. 8.

There is provided a threaded coupling 29 fixed to bar hinge support strut 31. The coupling 29 travels in an upward or downward direction along the worm thread 28 when the height adjusting handle 25 is turned. A rubber worm stay 35 is provided to maintain the parallel separation between the worm 28 and the support 21, as shown in FIG. 9. An integral spirit level 8 can be provided to assist horizontal alignment.

Figure 10:
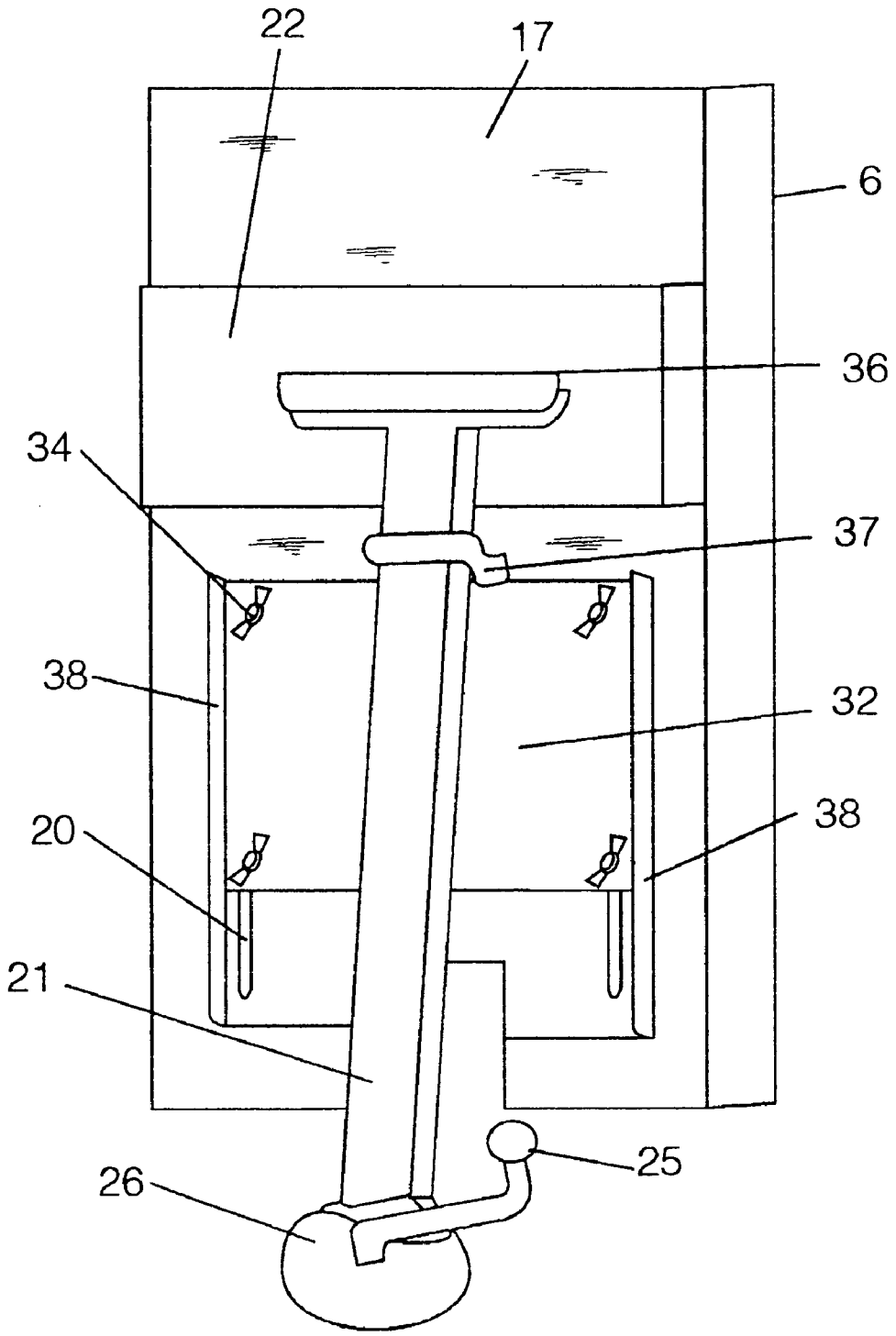
FIG. 10 shows a perspective view of the underside of the example shown in FIGS. 8 and 9 in its closed, portable/storage position.

When not in use, this example of a stair-ladder platform can be pivotally returned to the compact transportation/storage position about its axis as shown in FIG. 10, with a retaining strap 37 in place.

Figure 11:
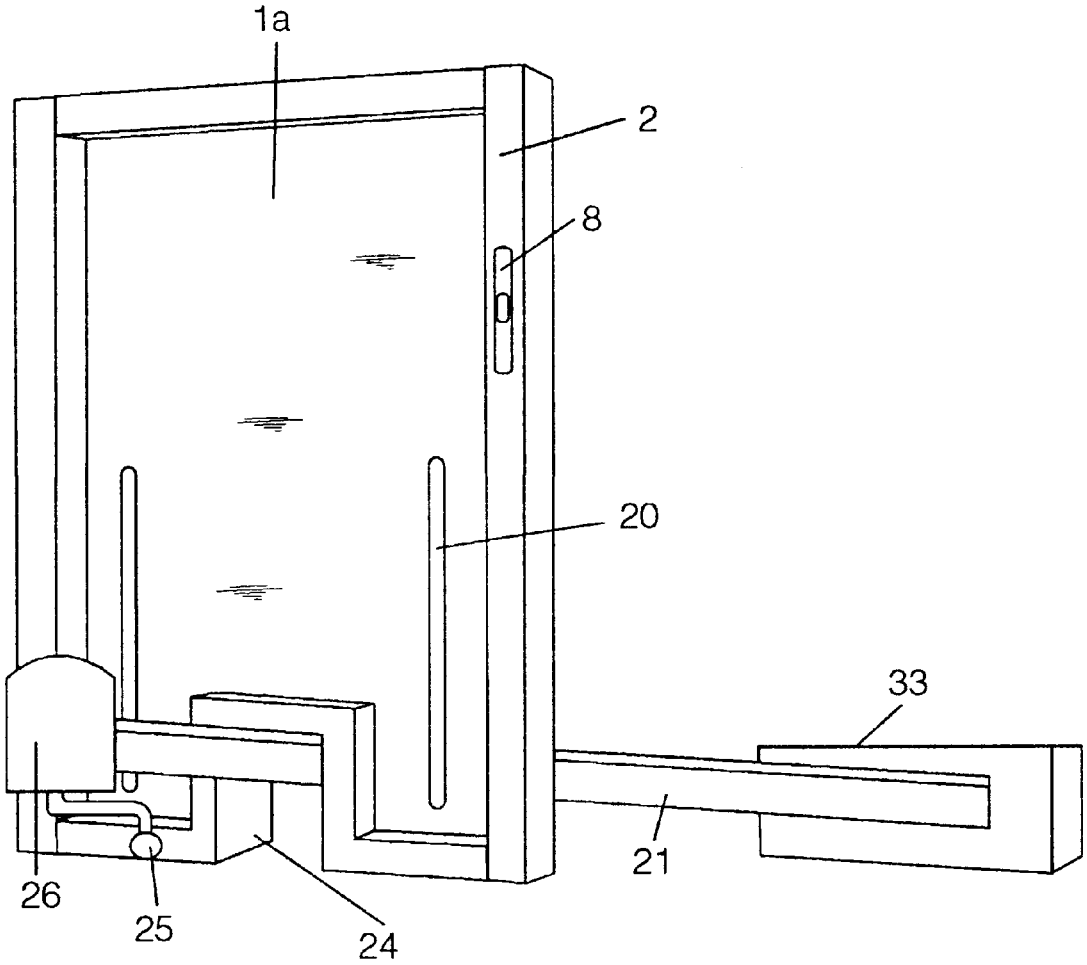
FIG. 11 shows a perspective view of an alternative foot member as an integral part of the example shown in FIGS. 8–10.
Figure 12:
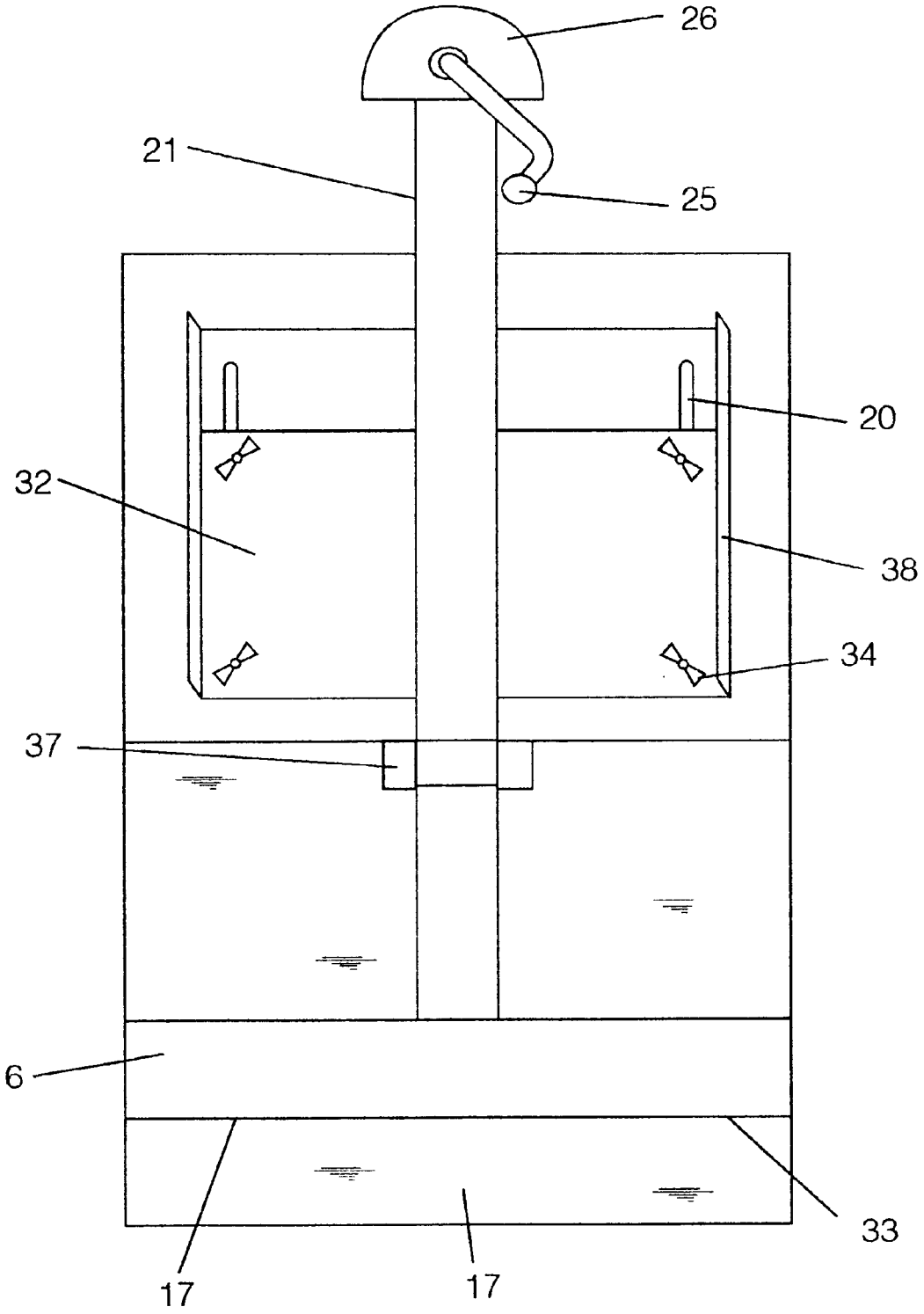
FIG. 12 shows a plan view of the underside of the example shown in FIG. 11.

A further addition to this example set out above is an alternative integral rigid support foot 33 incorporating plastic protection buffers 6 and a non-slip rubber stair grip 17, best shown in FIGS. 11 and 12.

Figure 13:
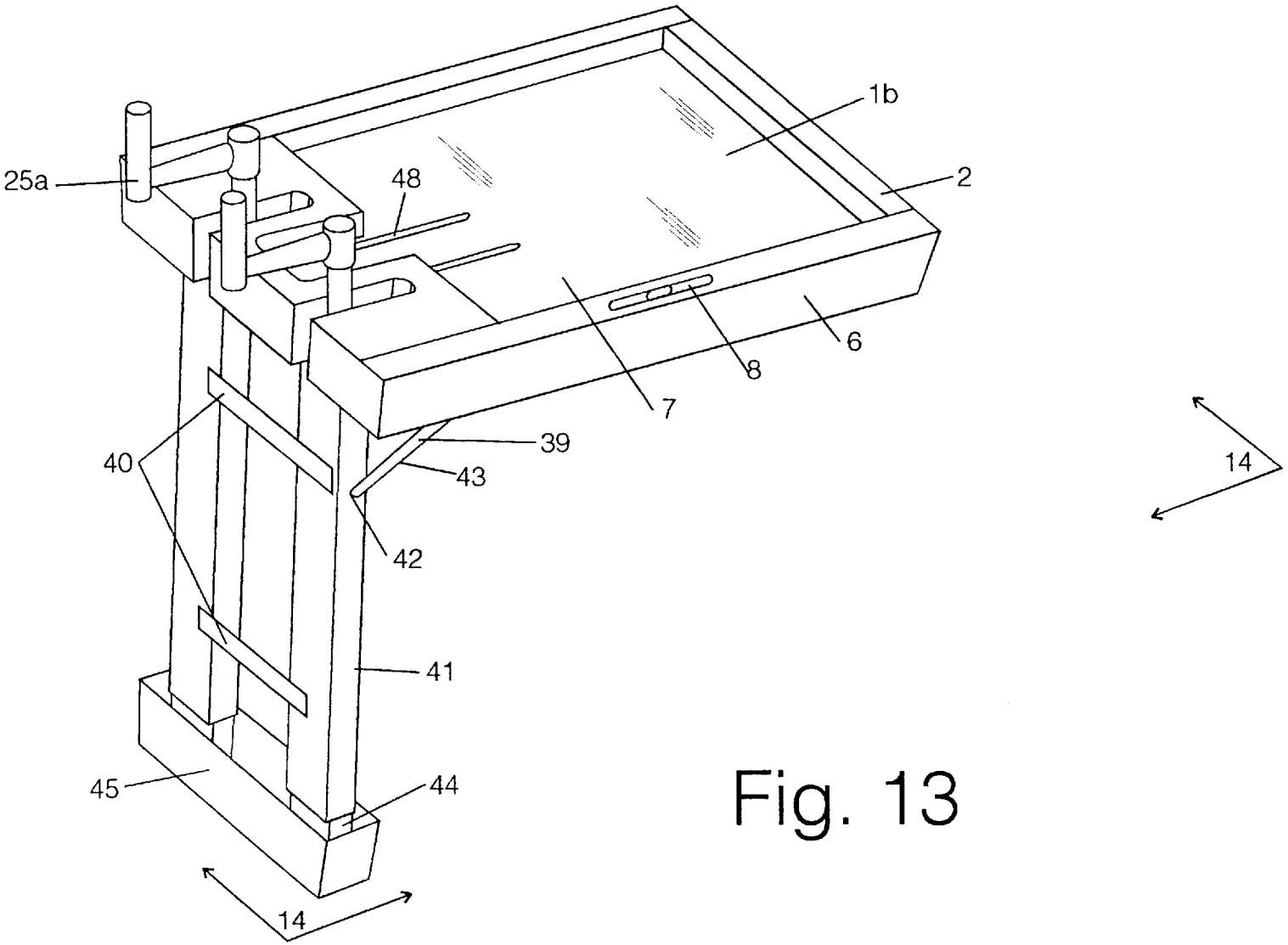
FIG. 13 shows a perspective view of a further alternative example.
Figure 16:
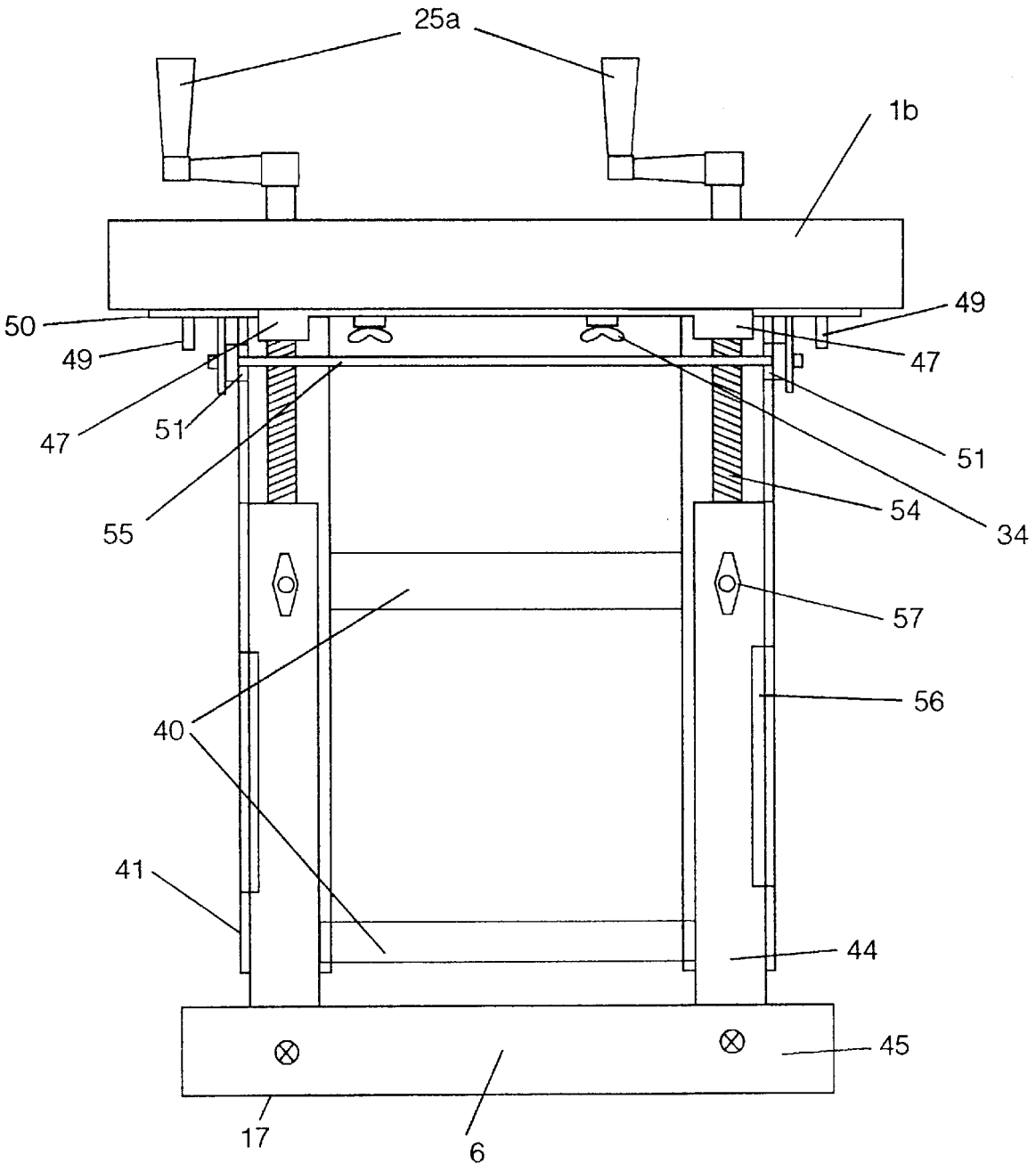
FIG. 16 shows a rear plan view of the example of a stair-ladder platform shown in FIGS. 13–15.

In addition, or as an alternative to the above examples, a further embodiment is described as follows. Referring to FIG. 13, there is provided a platform 1*b* for supporting a ladder 12 with integral ladder stops 2 and two vertical leg supports 41 joined by cross members 40, and pivotally attached by a bar hinge 55 passing through each vertical leg support 41 and fixed with locking collars 51 onto a width-adjusting slide plate 50 best shown in FIG. 16.

Figure 15:
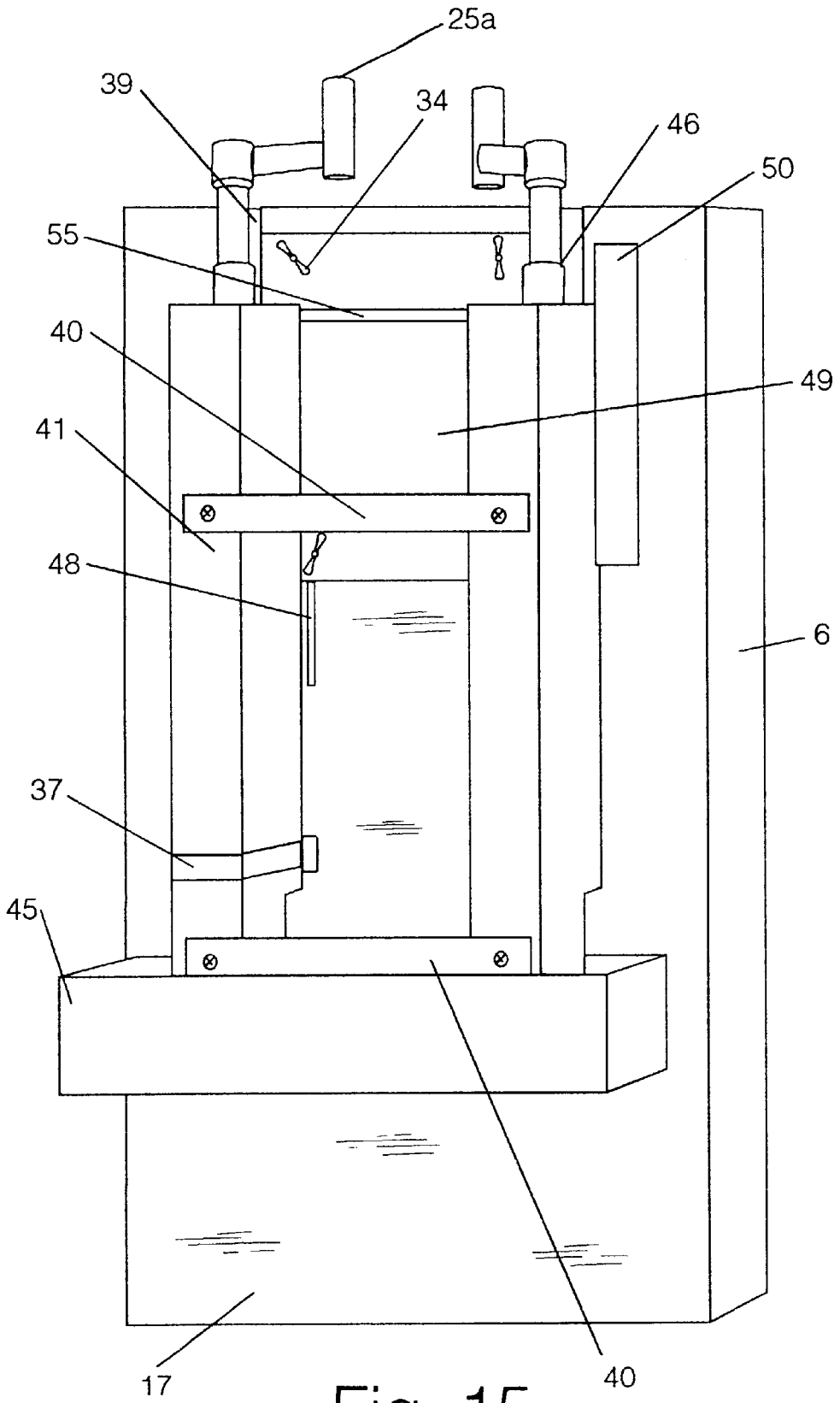
FIG. 15 shows a perspective view of the underside of the example shown in FIGS. 13–14.

The vertical leg supports 41 are pivoted parallel to the platform 1*c*, best shown in FIG. 15, to the vertical, as in FIG. 13, with the uppermost edge of the vertical leg supports 41 abutting the underside of the width-adjusting slide plate 50 at right angles. The base foot 45 is fixed as an integral member to adjustable legs 44 so as to sit firmly on the stair going 11.

Figure 14:
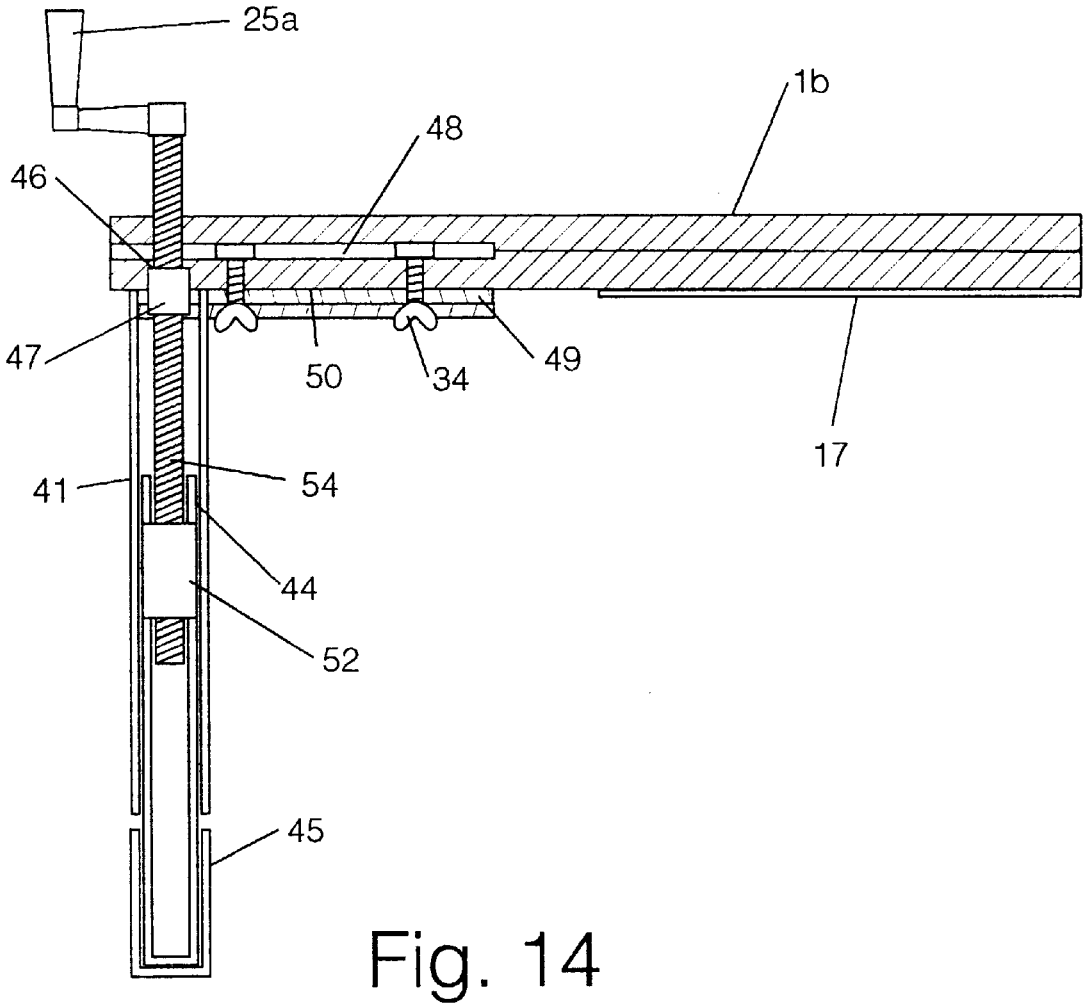
FIG. 14 shows a cross-sectional view taken substantially in the plane of the line 14—14 in FIG. 13.

The leg supports 41 can be adjusted to fit stair goings of varying widths. The width-adjusting means comprises the metal slide plate 50 guided within a slide plate 49, wing-nutted bolts 34 fixed through drilled holes in the metal slide plate 50 and locating recessed bolt guides 48, which incorporate a metal slide plate for ease of action, best shown in FIG. 14.

The height adjusting handles 25*a* are guided within handle slots 39 best shown in FIG. 13. The desired position on the stair going 11 is set by wing-nutted bolts 34.

The height adjusting mechanism comprises two vertical leg supports 41, each housing adjustable legs 44 and a height adjusting mechanism in the form of worms 54 locked in position by locking collars 47 abutting the upper enclosed face of support leg 41. The worm continues to a further set of locking collars 46 and in turn through to the two adjusting handles 25*a*. Along the worms 54 are provided worm couplings 52 which travel up or down the worms 54 depending on the direction of rotation of adjusting handles 25*a*. The worm couplings 52 are bolted to adjustable legs 44, thus raising or lowering the said members on rotation of the adjusting handles 25*a*. This in turn brings platform 1*b* to the horizontal. An integral spirit level 8 may be provided to assist alignment. When not in use, this stair-ladder platform can be pivotally returned to position shown in FIG. 15.

Figure 17:
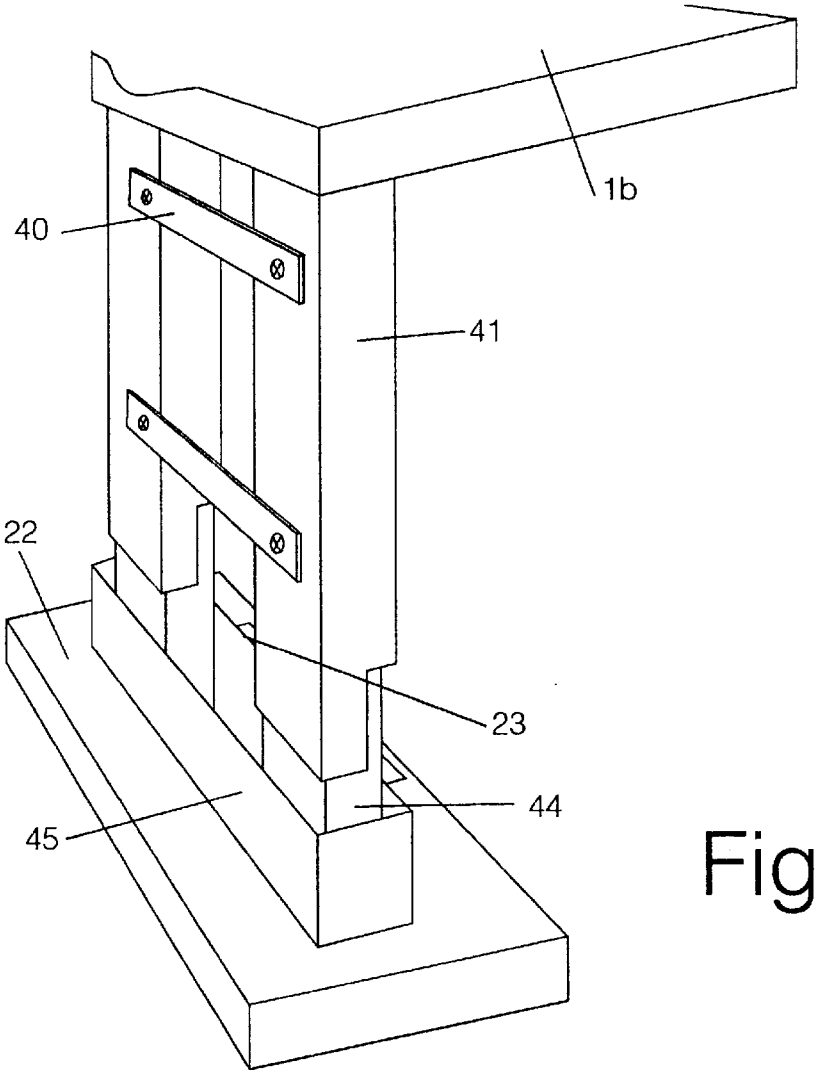
FIG. 17 shows in perspective an alternative base applied to the stair-ladder platform shown in FIGS. 13–16.

A further addition to the example set out above is an alternative hinged foot 22 as best shown in FIG. 17 attached by base hinges 23 to the base foot 45, the underside of which abuts the base surface forming a rigid structure when weight is applied.

Figure 18:
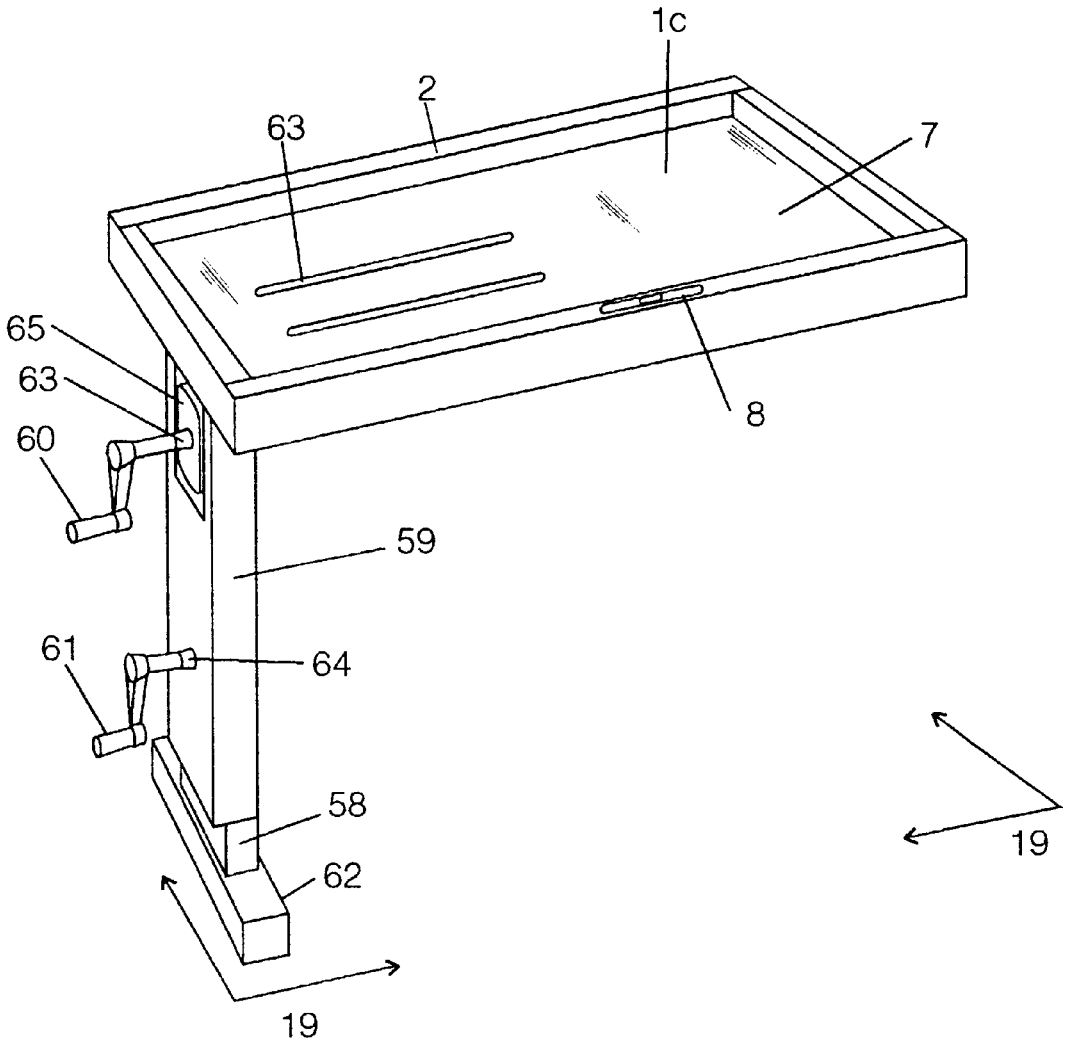
FIG. 18 shows in perspective a further alternative example of a stair-ladder platform.
Figure 19:
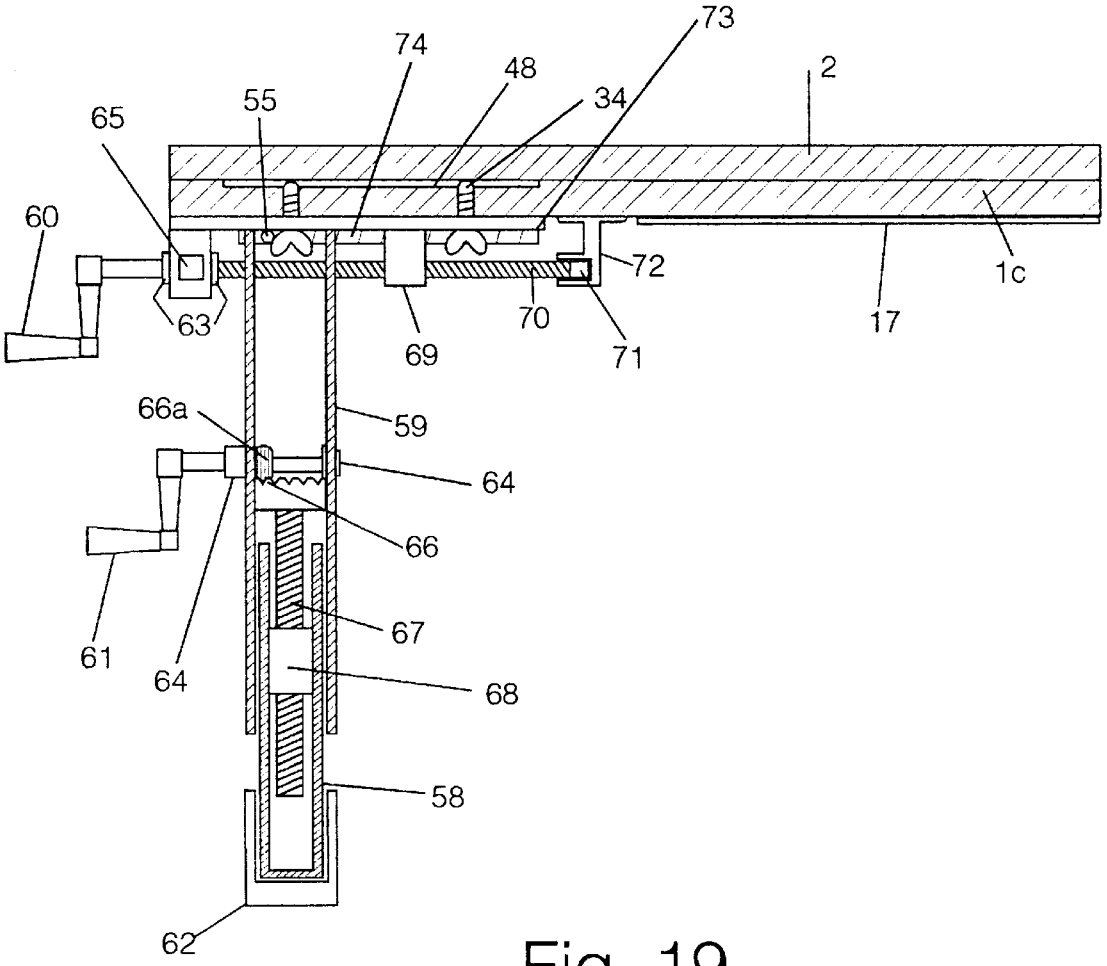
FIG. 19 shows a cross-sectional view taken substantially in the plane of the line 19—19 in FIG. 18.
Figure 20:
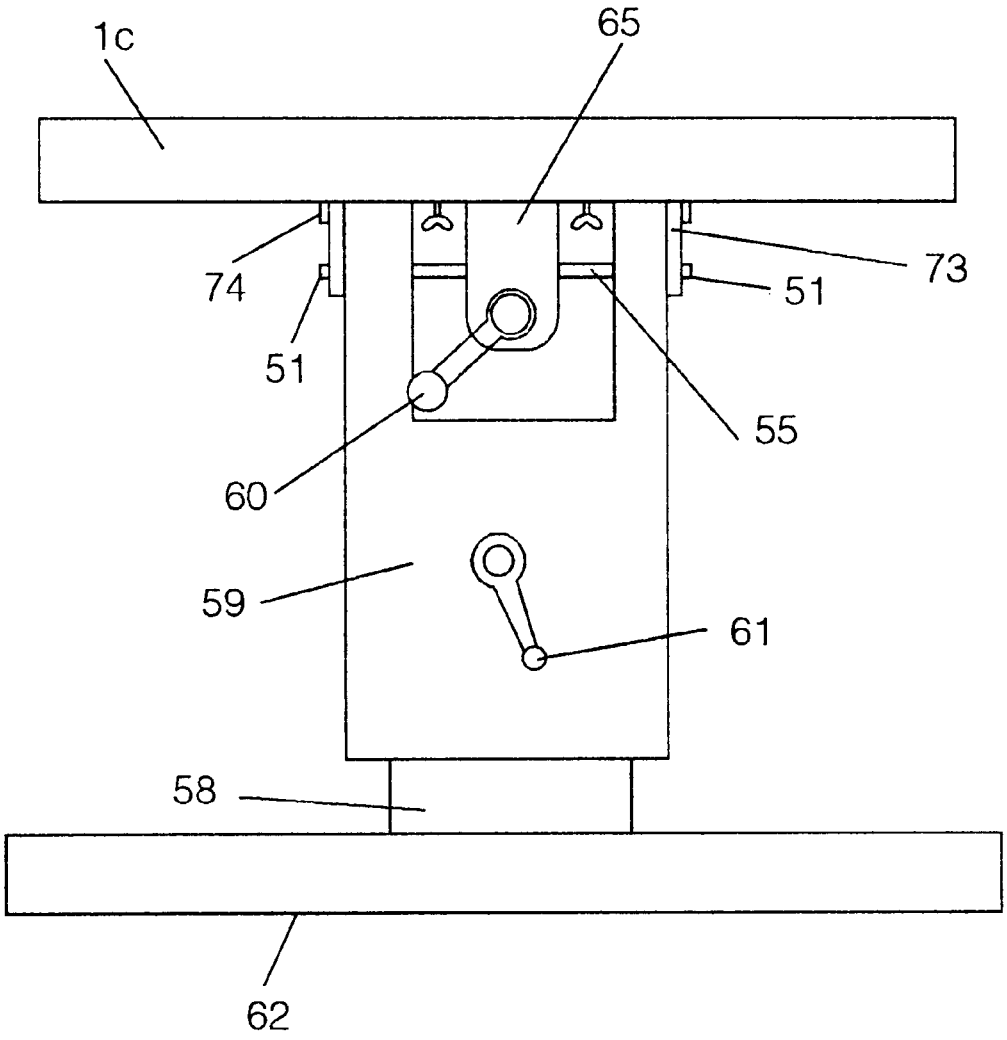
FIG. 20 shows a front plan view of the stair-ladder platform shown in FIGS. 18 and 19.
Figure 21:
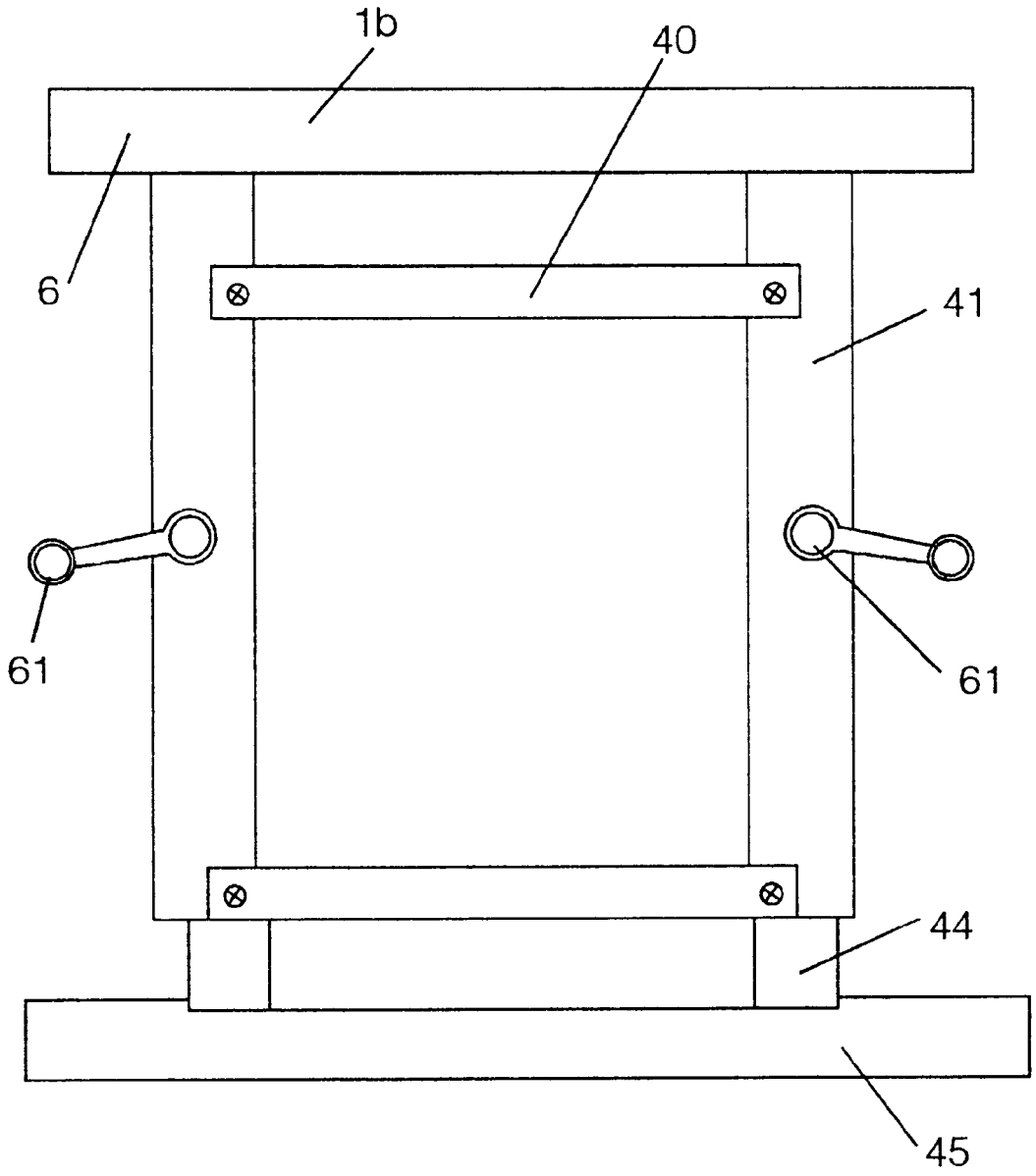
FIG. 21 shows an alternative positioning of the height handles applied to the example shown in FIG. 13 with the gearing mechanism shown in FIG. 19.

FIG. 18 illustrates an additional embodiment of the stair-ladder platform, comprising a platform 1*c* for supporting a ladder 12, a support member 59 pivotally attached by a bar hinge 55 passing through drilled holes in each portion of a vertical leg support 59, best shown in FIGS. 19 and 20. These in turn are locked into a width-adjusting slide plate 73 by bar collars 51. The slide plate 73 slides within slide plate guides 74. Wing-nutted bolts 34, located through drilled holes in slide plate 73, sit on a recessed metal slide plate 48 for ease of action.

The width-adjusting handle 60, when rotated, turns worm 70 within a handle guide 65 and is kept in position by locking collars 63. The worm coupling 69, located along the worm 70, is fixed to the slide plate 73 and in turn adjusts the slide plate 73 to the desired position, which in turn is set by wing-nutted bolts 34. A worm receiver 72, with a worm stay 71, is provided to maintain the worm 70 parallel to the platform 1*c*, as shown in FIG. 19.

The height adjustment comprises a vertical leg support 59 pivotally attached, as described above, to slide plate 73, encasing an adjustable leg 58 fixed to a worm coupling 68. The worm coupling 68 travels up and down the worm 67, when handle 61, fixed through the vertical support 59 and locked in position by locking collars 64, is rotated in either a clockwise or an anti-clockwise direction. There is provided for this action gearing wheels 66*a* and 66, best shown in FIG. 19. Gearing wheel 66*a* is fixed to the handle 61 and gearing wheel 66 is fixed to the worm 67. The integral base foot 62 in turn is raised or lowered so as to effect a horizontal alignment of platform 1*c* on the stair going 11. A spirit level 8 may be provided to assist alignment. When not required for use, this stair-ladder platform may be collapsed by carrying out the above sequence in reverse. It is important to note that when the distance between strings of staircases is relatively wide, e.g on institutional/industrial stairs, the stair-ladder platform does not need to be butted up against the stair string. The platform can be placed anywhere on the stair going and the ladder pitched anywhere within the platform, not necessarily against the ladder stops, to attain the recommended 75° pitch.

Figure 22:
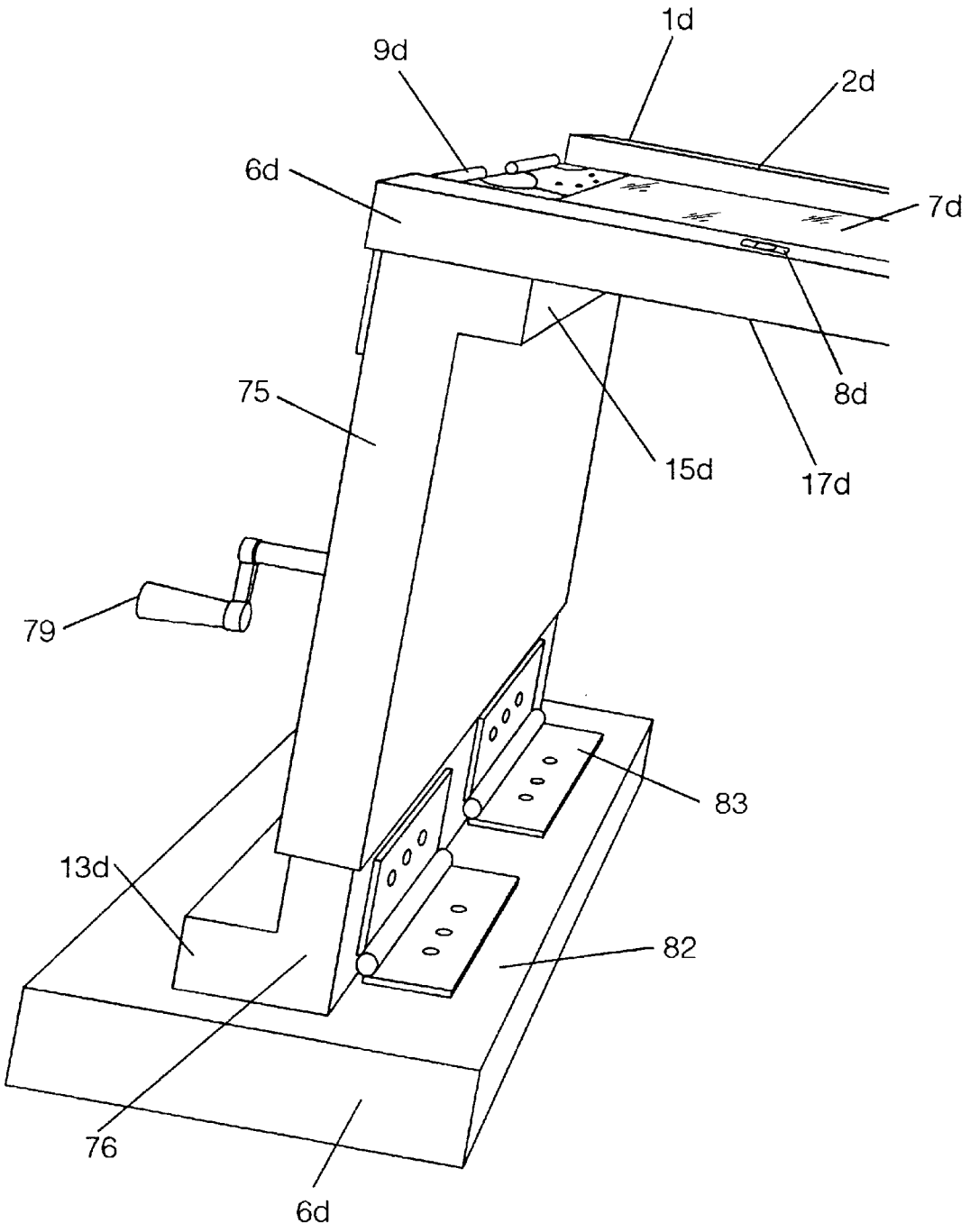
FIG. 22 shows in perspective a further alternative example of a stair-ladder platform with an alternative height adjusting method applied to the example shown in FIG. 2.
Figure 23:
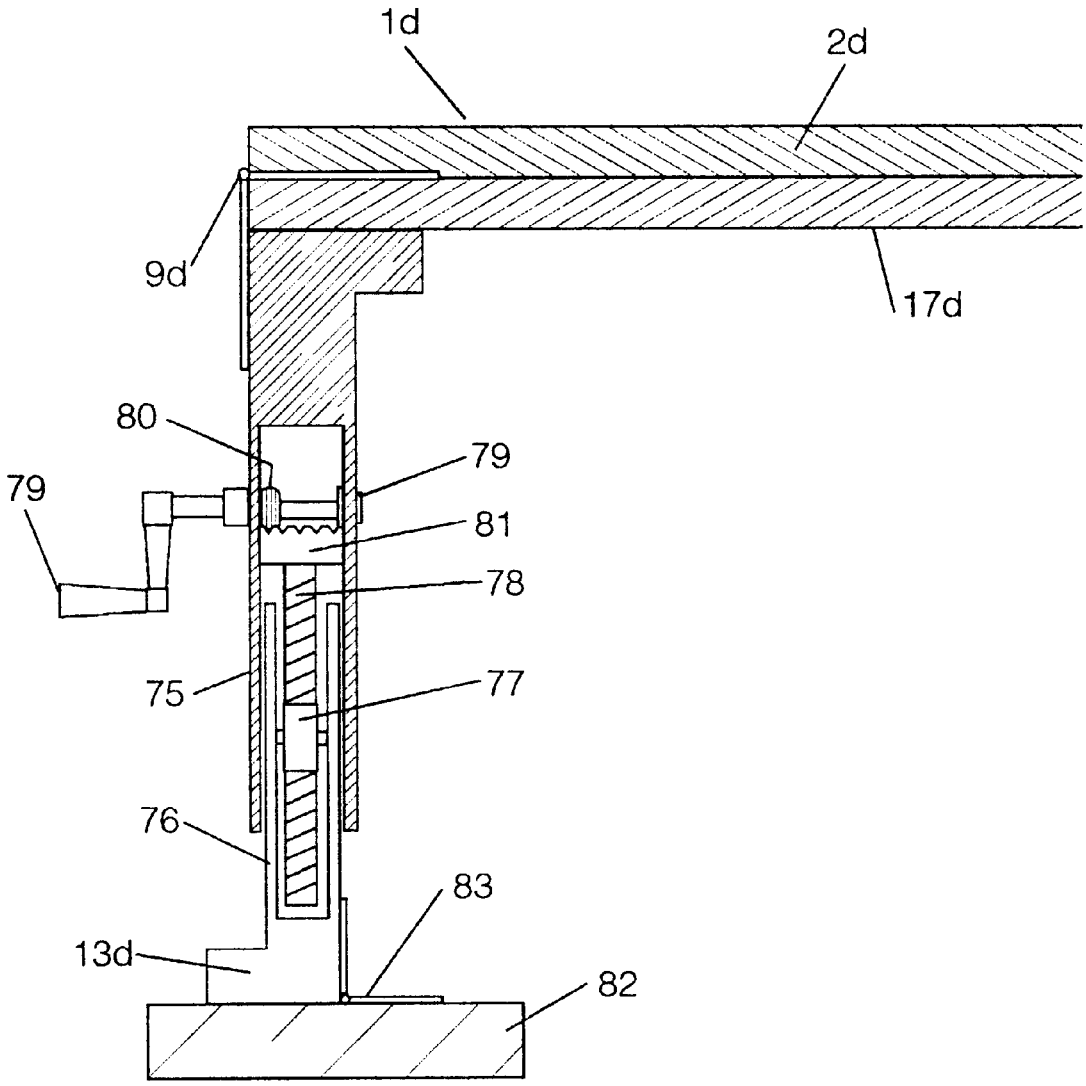
FIG. 23 is a cross-sectional view of the example shown in FIG. 22.

FIG. 22 illustrates an additional embodiment of the stair-ladder platform comprising a platform 1*d* with integral ladder stops 2*d* and a support member 75 pivotally attached by hinges 9*d* to platform 1*d*. A support-to-platform stop 15*d* fixed to the support member 75 abuts the platform 1*d* at right angles to the said member 75 as shown in FIG. 23. The height adjusting mechanism comprises a vertical support member 75 pivotally attached as described above to the platform 1*d* encasing an adjustable leg 76 fixed to a worm coupling 77. The worm coupling travels up and down the worm 78 when handle 79, fixed through the vertical support member 75 and locked in position by locking collars 79, is rotated in either a clockwise or an anti-clockwise direction. There is provided for this action gearing wheels 80 and 81 as shown in FIG. 23. A base foot 82, which is pivotally attached to adjustable leg 76 by hinges 83 (best shown in FIG. 22) is in turn raised or lowered so as to effect horizontal alignment of the platform 1*d* on the stair going 11. A spirit level 8*d* may be provided to assist alignment. The support-to-base stop 13*d* abuts base 82 and support leg 76 at right angles.

The edge of the platform 1*d* opposite to the platform hinges 9*d* is butted against the stair riser 10 as in FIG. 1. Buffers 6*d* located on the outer edge of platform 1*d* and base 82 provide protection for the surface abutted by the stair-ladder platform. A non-slip rubber stair grip 17*d* grips the stair going 11 when the ladder 12 is positioned on a non-slip ladder grip 7*d* as shown in FIG. 22 and pitched against the wall of the staircase and weight applied.

After use, the ladder 12 is removed and the stair-ladder platform is pivotally collapsed about its pivoted axis 9*d* and 83 in the manner shown in FIGS. 3 and 4. It is important to note that the opposing forces of the oppositely fixed hinges 9*d* and 83 along with the oppositely fixed support stops 13*d* and 83 form a rigid structure when weight is applied.

Figure 24:
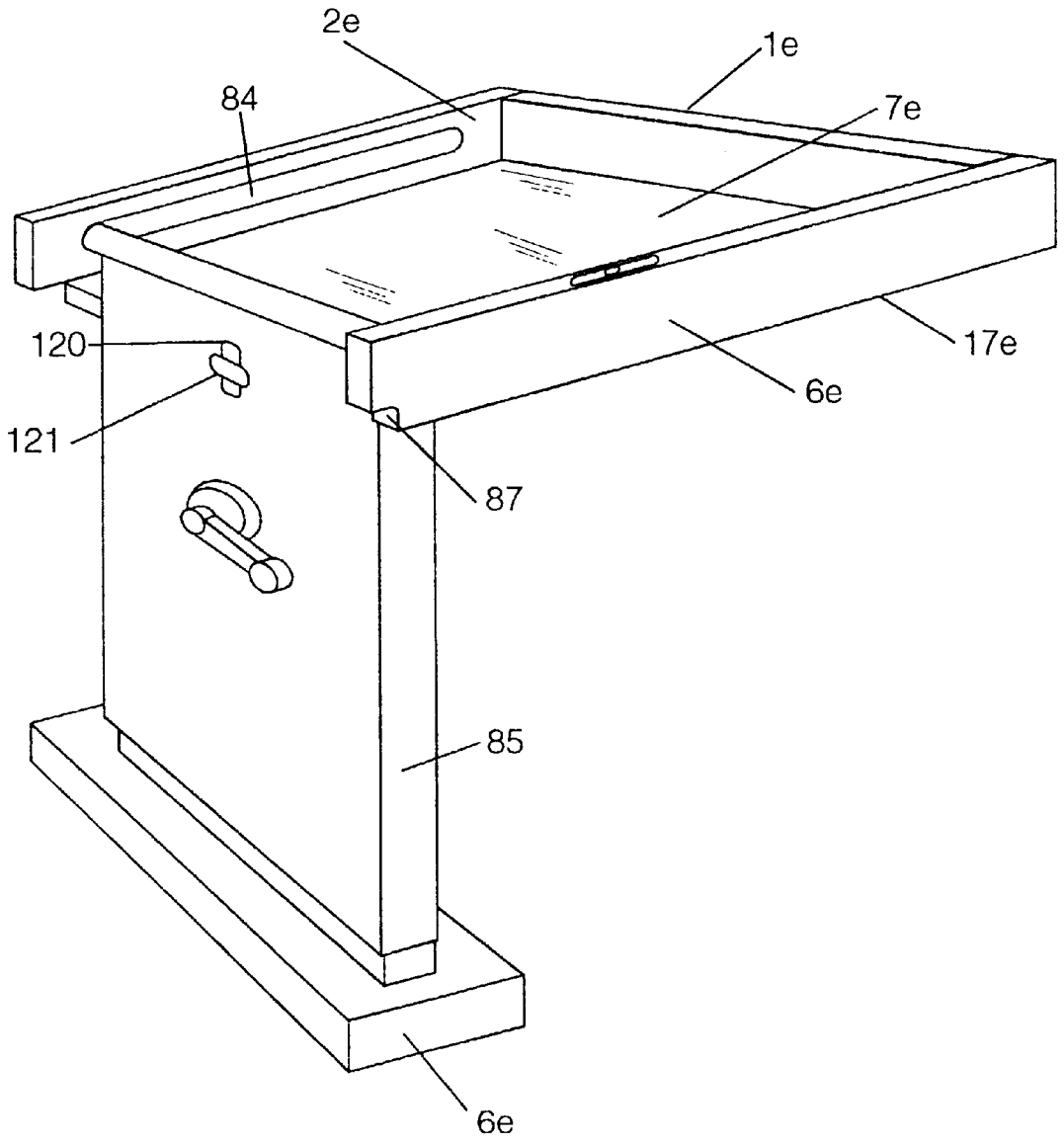
FIG. 24 shows in perspective a further alternative example of a stair-ladder platform.
Figure 25:
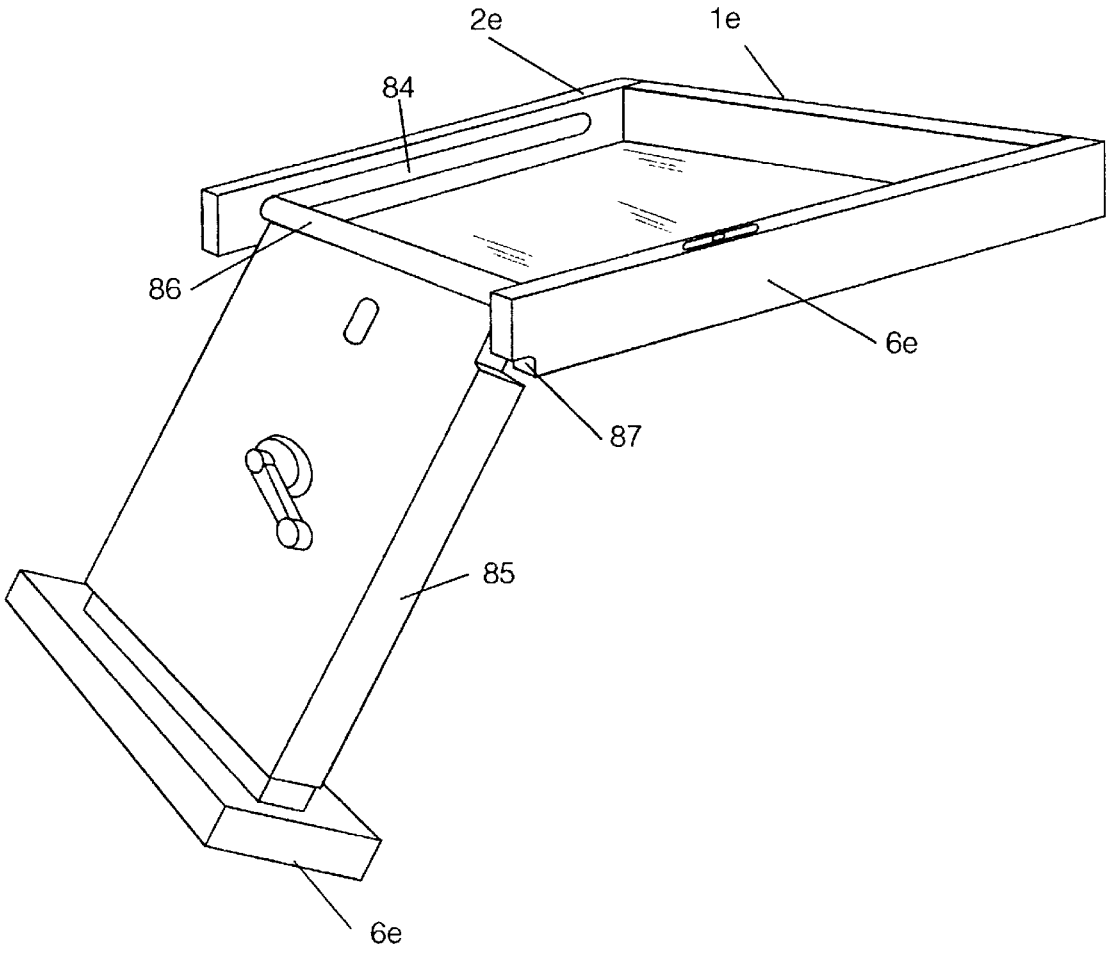
FIG. 25 shows a perspective view of the example shown in FIG. 24 in its partially folded position.
Figure 26:
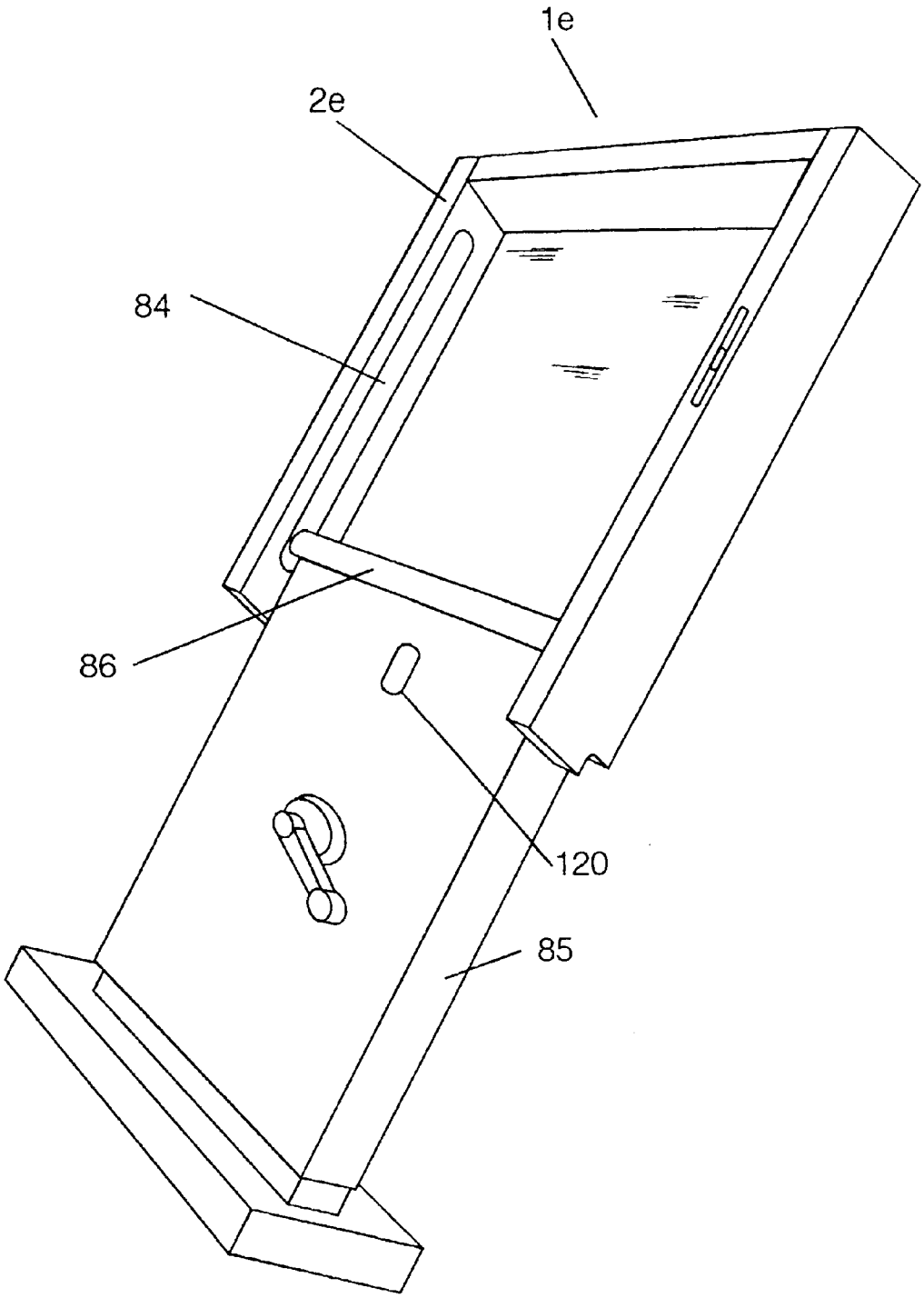
FIG. 26 shows a perspective view of the example shown in FIGS. 24–25 in a position prior to closure/storage.
Figure 27:
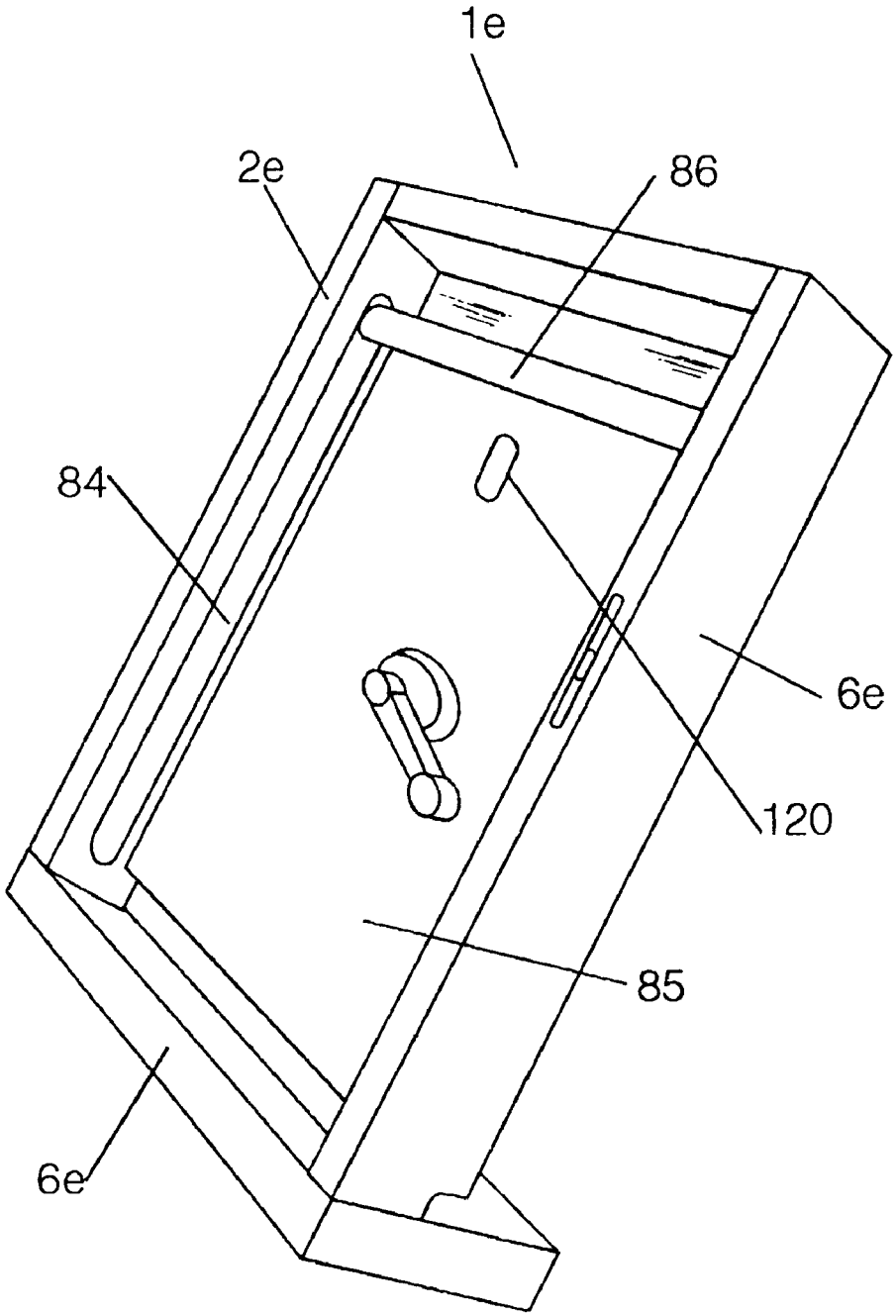
FIG. 27 shows a perspective view of the example shown in FIGS. 24–26 in a closed transportation position.
Figure 28:
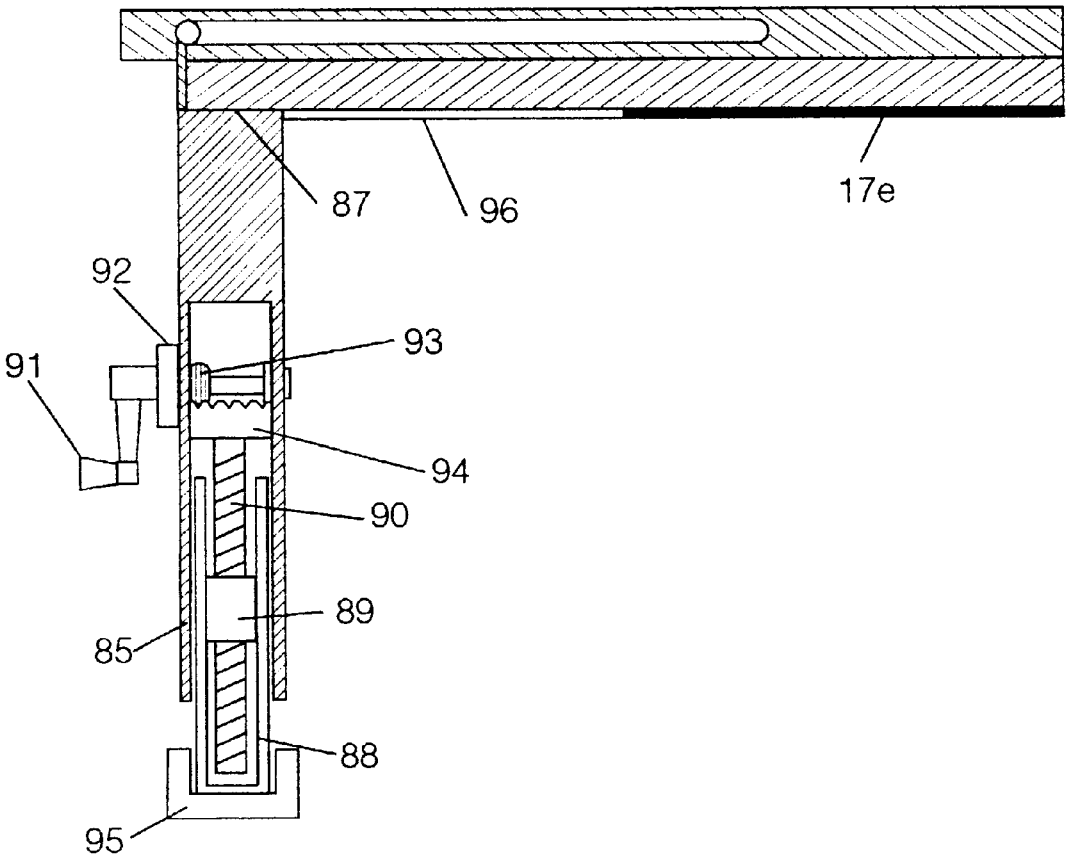
FIG. 28 is a cross-sectional view of the example shown in FIG. 24.

A further embodiment of the stair-ladder platform is shown in FIGS. 24–28. This alternative example comprises a platform 1*e* with integral ladder stops 2*e* incorporating pivot slide guides 84. A vertical support member 85 with an integral pivot bar 86 attaches to the platform 1*e* within the pivot slide guides 84, enabling the support member 85 to slide from a storage position best shown in FIG. 27 through to an operating position shown in FIG. 24 by pulling said member away from its housing in the manner illustrated in FIGS. 25 and 26. The support member 85 abuts the underside of platform 1*e* (as shown in FIGS. 24 and 28) at right angles with the integral pivot bar 86 stopping at the end of the pivot slide guides 84 (as shown in FIGS. 24 and 28). An additional locking means may be provided in the form of a turnkey 121 mounted at one end of the ladder support platform 1*e* and received by a hole 120 located in the support member 85. The abutting edge of the support member 85 rests within a recess 87 on the underside of the platform 1*e* as shown in FIGS. 24 and 28.

Encased within the support member 85 is provided a height adjusting mechanism in the form of an adjustable leg 88 fixed to a worm coupling 89. The worm coupling 89 travels up and down a worm 90 when a handle 91, fixed through the support member 85 and locked in position by locking collars 92, is rotated in either a clockwise or an anti-clockwise direction. There is provided for this action gearing wheels 93 and 94 as shown in FIG. 28. The integral base foot 95 in turn is raised or lowered so as to achieve horizontal alignment of the platform 1*e* on the stair going 11. A spirit level may be provided to assist alignment. The edge of the platform 1*e* opposite to the pivot bar 86 is butted up against the stair riser 10 as in FIG. 1. Buffers 6*e* located on the outer edge of the platform 1*e* and the base foot 95 are provided to protect the surface abutted by the stair-ladder platform. A non-slip rubber stair grip 17*e* grips the stair going 11 when the ladder 12 is positioned on a non-slip ladder grip 7*e* (as shown in FIG. 24) and pitched against the wall of the stairwell and weight applied. A support-to-platform stop 96 may be provided for additional stability.

After use, the above sequence is carried out in reverse so as to bring the stair-ladder platform into a configuration allowing compact storage and/or transportation.

Figure 29:
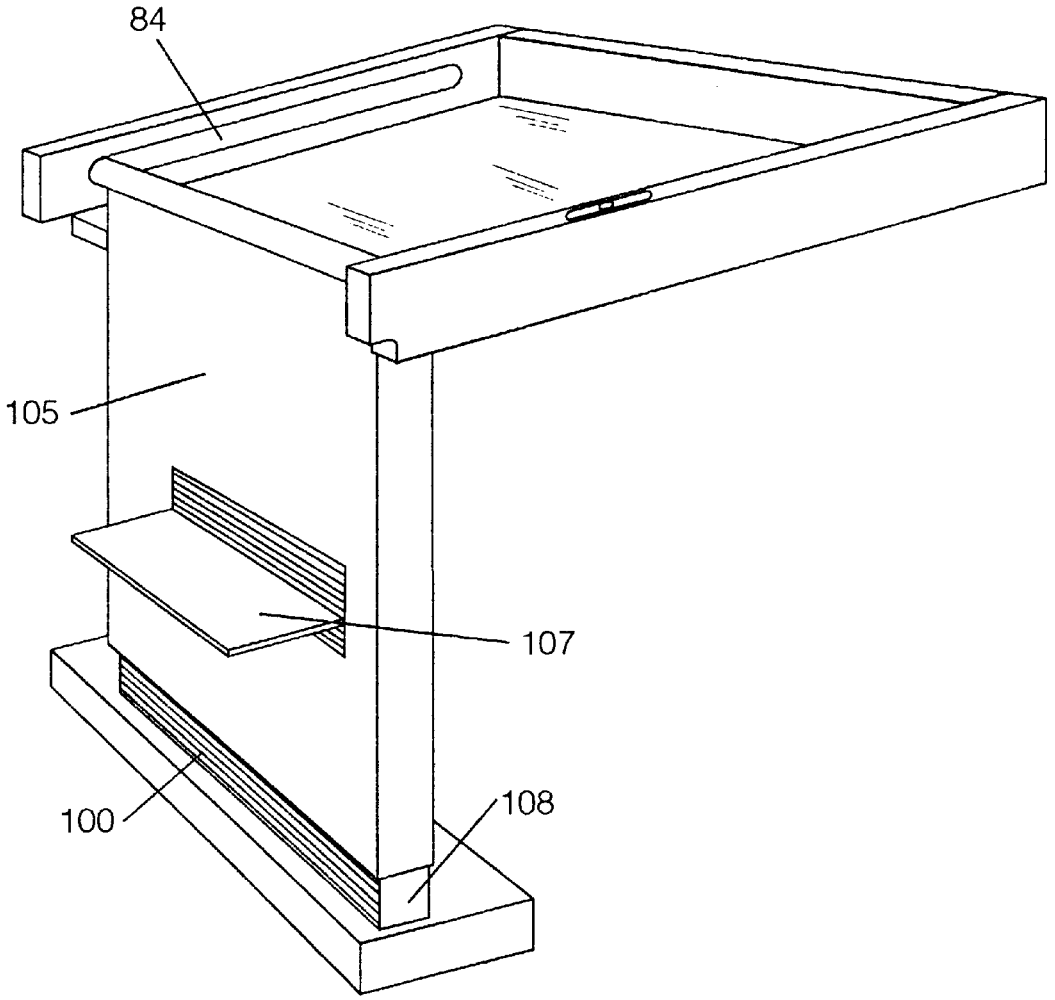
FIG. 29 shows in perspective a further alternative example of a stair-ladder platform comprising a ratchet mechanism.
Figure 30:
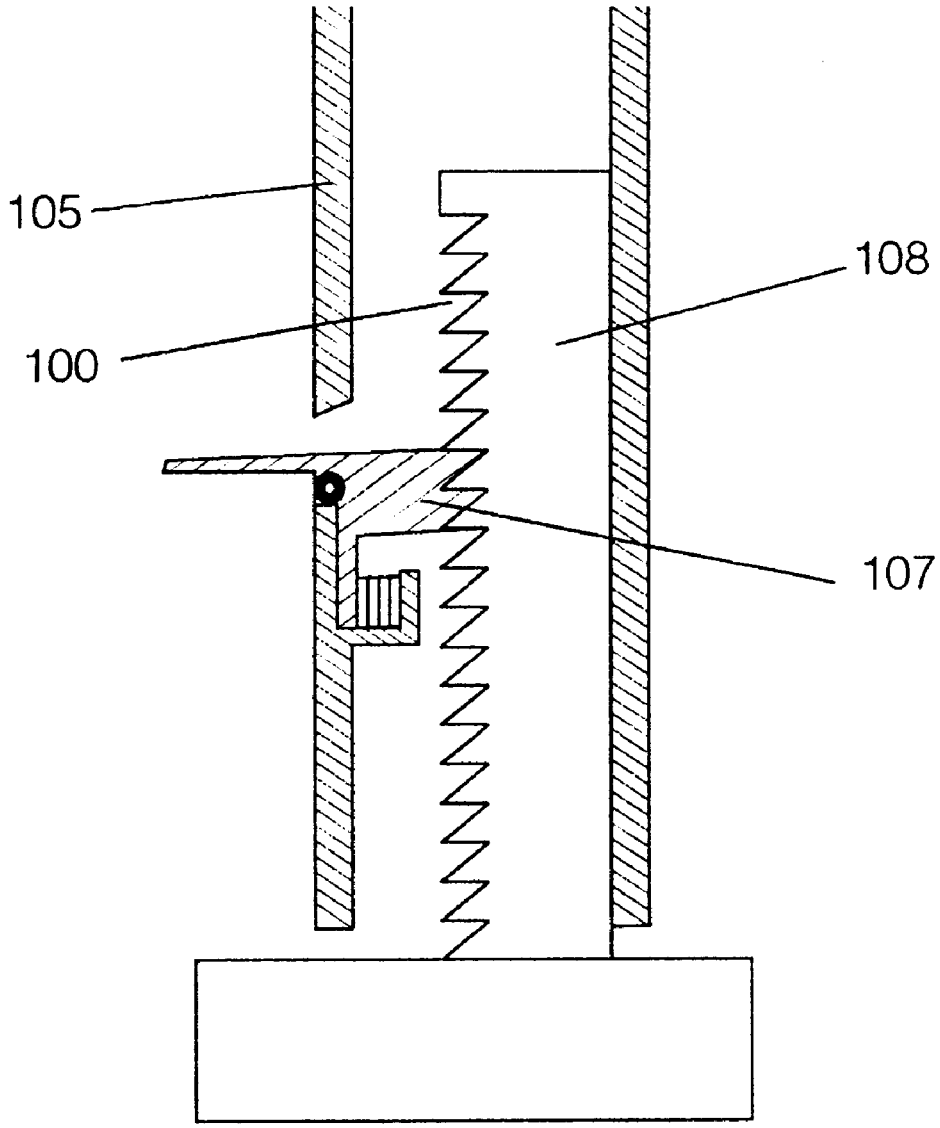
FIG. 30 is a cross-sectional view of the example shown in FIG. 29.

An alternative embodiment of the present invention comprising a ratchet-type height adjustment is shown in FIGS. 29 and 30. The support member 105 includes an adjustable leg 108, which leg is provided with a ratchet section 100. A pawl 101 is mounted on the support member 105 in such a way that the leg 108 may be telescopically extended from and retracted into the support member 105 by activating the pawl 101.

Figure 31:
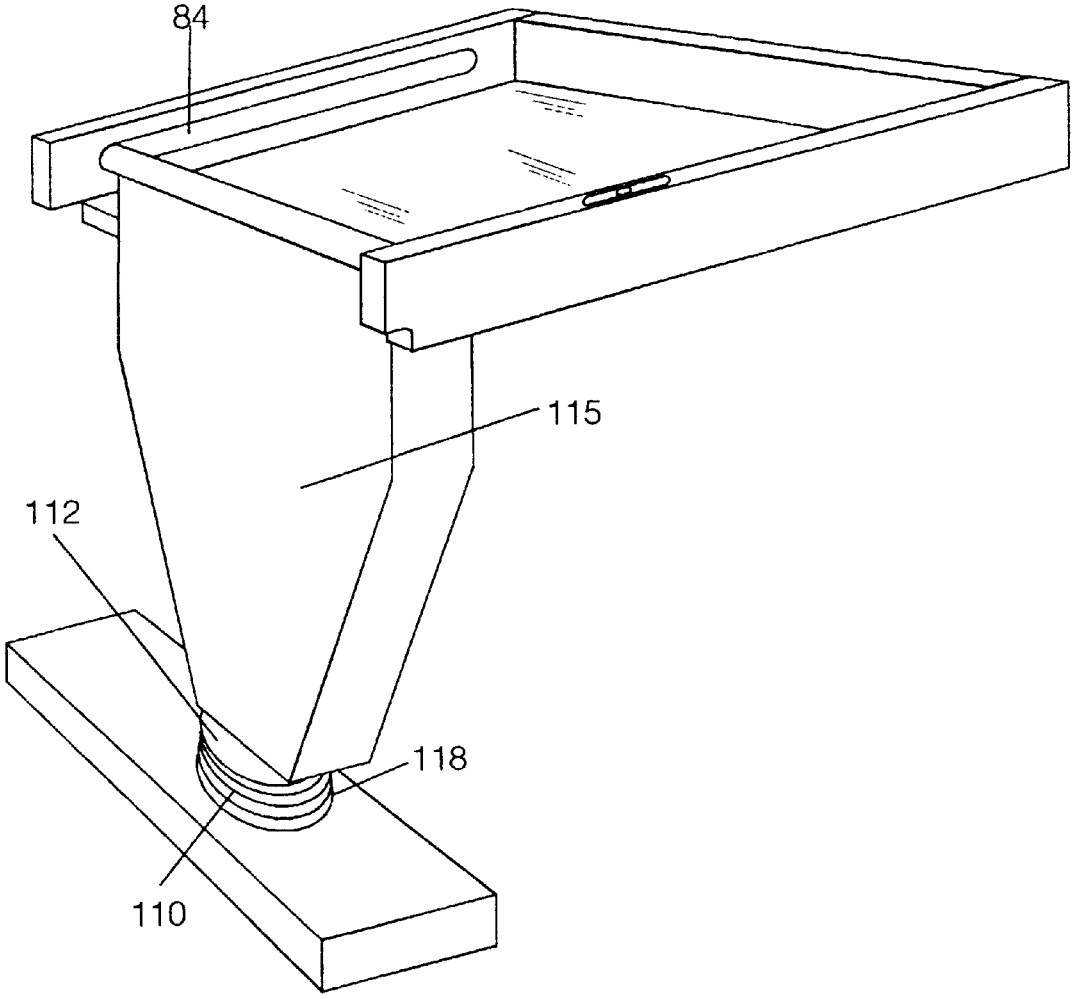
FIG. 31 shows in perspective a further alternative example of a stair-ladder platform comprising a screw mechanism.
Figure 32:
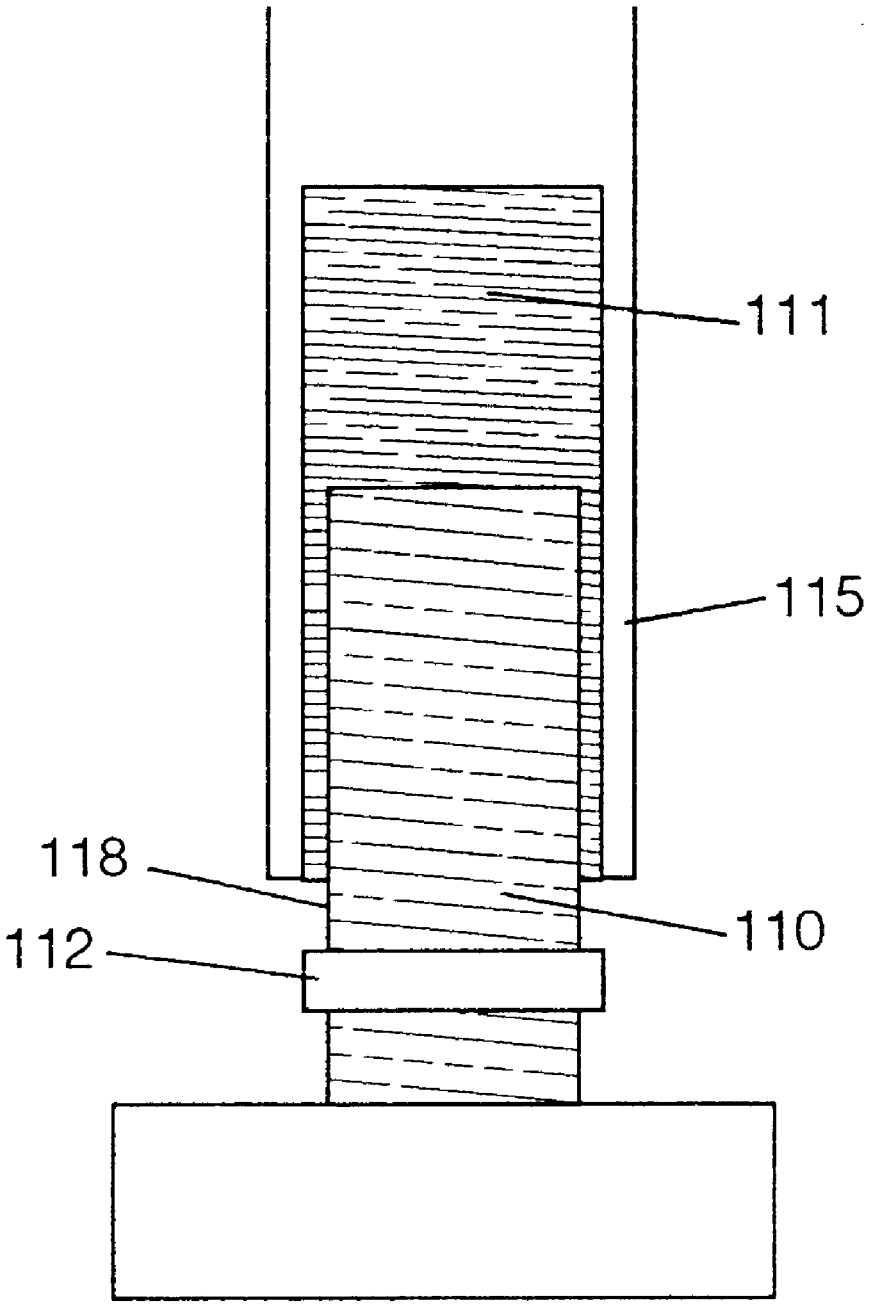
FIG. 32 is a cross-sectional view of the example shown in FIG. 31.

A further alternative embodiment of the present invention comprising a screw-type height adjustment is shown in FIGS. 31 and 32. The support member 115 includes an adjustable leg 118, which leg is provided with a screw thread 110 which engages with a complimentary screw thread 111 provided inside the support member 115. The leg 118 may be extended from and retracted into the support member 115 simply by rotation. For additional security, a locking nut 112 may be provided.

We claim:

1. A stair-ladder platform device which is collapsible for transportation and storage and comprises a ladder support platform having an upper support surface and a bottom surface for supporting a ladder on a flight of stairs and a support member pivotally attached to the platform by a pivotal coupling, the support platform and the support member being arranged such that, when assembled and in use with the ladder support platform substantially horizontal and the support member substantially vertical, an upwardly-facing surface area of the support member abuts an area of the bottom surface of the ladder support platform, the pivotal coupling and the abutting surface areas being arranged to tend to maintain substantially a right angle between the the support platform and the support member even when weight is applied to the ladder support platform, and the pivotal coupling being such as to prevent pivoting of the support member substantially beyond the vertical in that angular direction which is towards the bottom surface of the ladder support platform but allowing pivoting of the support member in an opposite direction so as to allow the device to be collapsed for transportation or storage;

wherein the ladder support platform has upwardly extending side walls defining a recessed portion on the upper supporting surface to receive the support member in the collapsed state of the device, and wherein the pivotal coupling comprises a slide whereby the support member is slidable relative to the ladder support platform, into the recessed portion when the device is being assembled or collapsed.

2. The device as claimed in claim 1, wherein the coupling comprises engagement means carried by one of the support member and the ladder support platform, which engagement means is slidably engageable in a pair of substantially parallel elongate guides provided along the length of the other of the support member and the ladder support platform.

3. The device as claimed in claim 2, comprising a base which, when the device is assembled and in use, is located at the lower end of the support member, and is shaped so that, when the device is in a collapsed state for transportation or storage, the base closes one end of a channel defined in the ladder support platform by the recessed portion.

4. The device as claimed in claim 3, wherein the base is non-pivotally attached to the support member.

5. The stair-ladder platform device as in claim 1 which is collapsible for transportation and storage and comprises a ladder support platform and a support member pivotally attached to the platform, wherein the support member is provided with a height adjustment in the form of a telescopic mechanism.

6. A device as claimed in claim 1, comprising a base which, when the device is assembled and in use, is located at the lower end of the support member, and is shaped so that, when the device is in a collapsed state for transportation or storage, the base closes one end of a channel defined in the ladder support platform by the recessed portion.

* * * * *